US007019720B2

(12) United States Patent
LeChevalier

(10) Patent No.: US 7,019,720 B2
(45) Date of Patent: Mar. 28, 2006

(54) ADAPTIVE CONTROL BOOST CURRENT METHOD AND APPARATUS

(75) Inventor: Robert LeChevalier, Golden, CO (US)

(73) Assignee: Clare Micronix Integrated Systems, Inc., Aliso Viejo, CA (US)

( * ) Notice: Subject to any disclaimer, the term of this patent is extended or adjusted under 35 U.S.C. 154(b) by 290 days.

(21) Appl. No.: 10/274,513

(22) Filed: Oct. 17, 2002

(65) Prior Publication Data

US 2003/0156101 A1 Aug. 21, 2003

Related U.S. Application Data

(60) Provisional application No. 60/342,637, filed on Oct. 19, 2001, provisional application No. 60/343,856, filed on Oct. 19, 2001, provisional application No. 60/343,638, filed on Oct. 19, 2001, provisional application No. 60/342,582, filed on Oct. 19, 2001, provisional application No. 60/346,102, filed on Oct. 19, 2001, provisional application No. 60/353,753, filed on Oct. 19, 2001, provisional application No. 60/342,793, filed on Oct. 19, 2001, provisional application No. 60/342,971, filed on Oct. 19, 2001, provisional application No. 60/343,370, filed on Oct. 19, 2001, provisional application No. 60/342,783, filed on Oct. 19, 2001, provisional application No. 60/342,794, filed on Oct. 19, 2001.

(51) Int. Cl.
*G09G 3/32* (2006.01)

(52) U.S. Cl. ..... 345/82; 345/60; 345/87

(58) Field of Classification Search ..... 345/82
See application file for complete search history.

(56) References Cited

U.S. PATENT DOCUMENTS 4,236,199 A 11/1980 Stewart
4,366,504 A 12/1982 Kanatani
4,603,269 A 7/1986 Hochstein
RE32,526 E 10/1987 Hochstein
4,823,121 A 4/1989 Sakamoto et al.
5,117,426 A 5/1992 McAdams
5,162,688 A 11/1992 Bouton
5,514,995 A 5/1996 Hennig
5,519,712 A 5/1996 Shu et al.
5,594,463 A 1/1997 Sakamoto
5,606,527 A 2/1997 Kwack et al.
5,672,992 A 9/1997 Nadd
5,686,936 A 11/1997 Maekawa et al.

(Continued)

FOREIGN PATENT DOCUMENTS

EP 1 081 836 A2 8/1995

(Continued)

OTHER PUBLICATIONS

International Search Report dated Apr. 8, 2004 for International Application No. PCT/US02/33373.

(Continued)

*Primary Examiner*—Sumati Lefkowitz
*Assistant Examiner*—Ke Xiao
(74) *Attorney, Agent, or Firm*—Knobbe, Martens, Olson & Bear, LLP

(57) ABSTRACT

A method and apparatus for adapting and applying current boost levels to precharge current-driven elements in a matrix, and a method to make devices for this purpose. Elements are driven during successive scan cycles, each having a precharge period and an exposure period. One or more conduction voltages are sensed while an element conducts a selected exposure current, with early samples taken nearer the beginning of exposures and late samples taken nearer the end. Charge delivered during the precharge period is adjusted to reduce differences between early and late voltage samples.

74 Claims, 10 Drawing Sheets

U.S. PATENT DOCUMENTS

| | | | | |
|---|---|---|---|---|
| 5,689,208 | A | 11/1997 | Nadd | |
| 5,708,454 | A | 1/1998 | Katoh et al. | |
| 5,764,207 | A | 6/1998 | Maekawa et al. | |
| 5,818,268 | A | 10/1998 | Kim et al. | |
| 5,844,368 | A | 12/1998 | Okuda et al. | |
| 5,949,194 | A | 9/1999 | Kawakami et al. | |
| 5,952,789 | A | 9/1999 | Stewart et al. | |
| 6,067,061 | A | 5/2000 | Friedman | |
| 6,075,739 | A | 6/2000 | Ihara | |
| 6,181,314 | B1 | 1/2001 | Nakajima et al. | |
| 6,191,534 | B1 | 2/2001 | Schuler et al. | |
| 6,201,717 | B1 | 3/2001 | Grant | |
| 6,229,508 | B1 | 5/2001 | Kane | |
| 6,313,819 | B1 | 11/2001 | Maekawa et al. | |
| 6,366,116 | B1 | 4/2002 | Juang | |
| 6,433,488 | B1 | 8/2002 | Bu | |
| 6,448,948 | B1 | 9/2002 | Friedman | |
| 6,473,064 | B1 | 10/2002 | Tsuchida et al. | |
| 6,489,631 | B1 | 12/2002 | Young et al. | |
| 6,583,775 | B1 | 6/2003 | Sekiya et al. | |
| 6,584,589 | B1 | 6/2003 | Pemer et al. | |
| 6,594,606 | B1 * | 7/2003 | Everitt | 702/107 |
| 6,633,135 | B1 | 10/2003 | Nara et al. | |
| 6,650,308 | B1 | 11/2003 | Kawashima | |
| 6,661,401 | B1 | 12/2003 | Sekine | |
| 6,714,177 | B1 | 3/2004 | Ishizuka | |
| 6,859,193 | B1 | 2/2005 | Yumoto | |
| 2001/0024186 | A1 | 9/2001 | Kane et al. | |

FOREIGN PATENT DOCUMENTS

| | | | |
|---|---|---|---|
| EP | 0 678 849 | A1 | 10/1995 |
| EP | 1 071 070 | A2 | 1/2001 |
| EP | 1 081 836 | A2 | 3/2001 |
| EP | 1 071 070 | A3 | 1/2002 |
| GB | 2 337 354 | A | 12/1995 |
| GB | 2 339 638 | | 11/1999 |
| GB | 2 339 638 | A | 2/2000 |
| JP | 59-97223 | | 6/1984 |
| JP | 4-172963 | | 6/1992 |
| JP | 07-199861 | | 8/1995 |
| JP | 7-322605 | | 12/1995 |
| JP | 07-322605 | | 11/1999 |
| JP | 11-330376 | | 11/1999 |
| JP | 11-330376 | | 1/2001 |
| JP | 59-97223 | | 3/2001 |
| JP | 04-172963 | | 1/2002 |
| WO | WO 01/27910 | A1 | 4/2001 |

OTHER PUBLICATIONS

International Search Report dated Jun. 26, 2003 for International Application No. PCT/US02/33364, filed Oct. 17, 2002.

International Search Report dated Apr. 8, 2004 for International Application No. PCT/US02/33373.

International Search Report dated Jun. 26, 2003 for International Application No. PCT/US02/33428, filed Oct. 17, 2002.

International Search Report dated Jun. 26, 2003 for International Application No. PCT/US02/33519, filed Oct. 17, 2002.

International Search Report dated Nov. 27, 2003 for International Application No. PCT/US02/14699, filed May 7, 2002.

International Search Reported dated Nov. 28, 2003 for international Application No. PCT/US02/14686, filed May 7, 2002.

International Search Report for International Application No. PCT/US02/33375, filed Oct. 17, 2002, dated Jun. 23, 2003.

International Search Report for International Application No. PCT/US02/33426, filed Oct. 17, 2002, dated Jun. 23, 2003.

International Search Report for International Application No. PCT/US02/33574, filed Oct. 17, 2002, dated Jun. 23, 2003.

* cited by examiner

ADAPTIVE CONTROL BOOST CURRENT METHOD AND APPARATUS

RELATED APPLICATIONS

This application claims priority to, and hereby incorporates by reference, the following patent applications:

U.S. Provisional Patent Application No. 60/342,637, filed on Oct. 19, 2001, entitled PROPORTIONAL PLUS INTEGRAL LOOP COMPENSATION USING A HYBRID OF SWITCHED CAPACITOR AND LINEAR AMPLIFIERS;

U.S. Provisional Patent Application No. 60/343,856, filed on Oct. 19, 2001, entitled CHARGE PUMP ACTIVE GATE DRIVE;

U.S. Provisional Patent Application No. 60/343,638, filed on Oct. 19, 2001, entitled CLAMPING METHOD AND APPARATUS FOR SECURING A MINIMUM REFERENCE VOLTAGE IN A VIDEO DISPLAY BOOST REGULATOR;

U.S. Provisional Patent Application No. 60/342,582, filed on Oct. 19, 2001, entitled PRECHARGE VOLTAGE ADJUSTING METHOD AND APPARATUS;

U.S. Provisional Patent Application No. 60/346,102, filed on Oct. 19, 2001, entitled EXPOSURE TIMING COMPENSATION FOR ROW RESISTANCE;

U.S. Provisional Patent Application No. 60/353,753, filed on Oct. 19, 2001, entitled, METHOD AND SYSTEM FOR PRECHARGING OLED/PLED DISPLAYS WITH A PRECHARGE SWITCH LATENCY;

U.S. Provisional Patent Application No. 60/342,793, filed on Oct. 19, 2001, entitled ADAPTIVE CONTROL BOOST CURRENT METHOD AND APPARATUS, filed on Oct. 19, 2001;

U.S. Provisional Patent Application No. 60/342,791, filed on Oct. 19, 2001, entitled PREDICTIVE CONTROL BOOST CURRENT METHOD AND APPARATUS;

U.S. Provisional Patent Application No. 60/343,370, filed on Oct. 19, 2001, entitled RAMP CONTROL BOOST CURRENT METHOD AND APPARATUS;

U.S. Provisional Patent Application No. 60/342,783, filed on Oct. 19, 2001, entitled ADJUSTING PRECHARGE FOR CONSISTENT EXPOSURE VOLTAGE; and U.S. Provisional Patent Application No. 60/342,794, filed on Oct. 19, 2001, entitled PRECHARGE VOLTAGE CONTROL VIA EXPOSURE VOLTAGE RAMP;

This application is related to, and hereby incorporates by reference, the following patent applications:

U.S. Provisional Application No. 60/290,100, filed May 9, 2001, entitled "METHOD AND SYSTEM FOR CURRENT BALANCING IN VISUAL DISPLAY DEVICES", U.S. patent application Ser. No. 10/141,650 entitled "CURRENT BALANCING CIRCUIT", filed May 7, 2002;

U.S. patent application Ser. No. 10/141,325 entitled "CURRENT BALANCING CIRCUIT", filed May 7, 2002;

U.S. patent application Ser. No. 09/904,960, filed Jul. 13, 2001, entitled "BRIGHTNESS CONTROL OF DISPLAYS USING EXPONENTIAL CURRENT SOURCE";

U.S. patent application Ser. No. 10/141659, filed on May 7, 2002, entitled "MATCHING SCHEME FOR CURRENT CONTROL IN SEPARATE I.C.S.";

U.S. patent application Ser. No. 10/141326, filed May 7, 2002, entitled "MATCHING SCHEME FOR CURRENT CONTROL IN SEPARATE I.C.S.";

U.S. patent application Ser. No. 09/852,060, filed May 9, 2001, entitled "MATRIX ELEMENT VOLTAGE SENSING FOR PRECHARGE";

U.S. patent application Ser. No. 10/274,429 entitled "METHOD AND SYSTEM FOR PROPORTIONAL AND INTEGRAL LOOP COMPENSATION USING A HYBRID OF SWITCHED CAPACITOR AND LINEAR AMPLIFIERS", filed on even date herewith;

U.S. patent application Ser. No. 10/274,488 entitled "METHOD AND SYSTEM FOR CHARGE PUMP ACTIVE GATE DRIVE", filed on even date herewith;

U.S. patent application Ser. No. 10/274,428 entitled "METHOD AND CLAMPING APPARATUS FOR SECURING A MINIMUM REFERENCE VOLTAGE IN A VIDEO DISPLAY BOOST REGULATOR", filed on even date herewith;

U.S. patent application Ser. No. 10/141,648, filed May 7, 2002, entitled "APPARATUS FOR PERIODIC ELEMENT VOLTAGE SENSING TO CONTROL PRECHARGE";

U.S. patent application Ser. No. 10/141,318, filed May 7, 2002, entitled "METHOD FOR PERIODIC ELEMENT VOLTAGE SENSING TO CONTROL PRECHARGE,";

U.S. patent application Ser. No. 10/744,489 entitled "MATRIX ELEMENT PRECHARGE VOLTAGE ADJUSTING APPARATUS AND METHOD", filed on even date herewith;

U.S. patent application Ser. No. 10/274,491 entitled "SYSTEM AND METHOD FOR EXPOSURE TIMING COMPENSATION FOR ROW RESISTANCE", filed on even date herewith;

U.S. patent application Ser. No. 10/274,421 entitled "METHOD AND SYSTEM FOR PRECHARGING OLED/PLED DISPLAYS WITH A PRECHARGE LATENCY", filed on even date herewith;

U.S. Provisional Application No. 60/348,168 filed Oct. 19, 2001, entitled "PULSE AMPLITUDE MODULATION SCHEME FOR OLED DISPLAY DRIVER", filed on even date herewith;

U.S. patent application Ser. No. 10/029,563, filed Dec. 20, 2001, entitled "METHOD OF PROVIDING PULSE AMPLITUDE MODULATION FOR OLED DISPLAY DRIVERS";

U.S. patent application Ser. No. 10/029,605, filed Dec. 20, 2001, entitled "SYSTEM FOR PROVIDING PULSE AMPLITUDE MODULATION FOR OLED DISPLAY DRIVERS";

U.S. patent application Ser. No. 10/275,490 entitled "PREDICTIVE CONTROL BOOST CURRENT METHOD AND APPARATUS", filed on even date herewith;

U.S. patent application Ser. No. 10/274,500 entitled "RAMP CONTROL BOOST CURRENT METHOD", filed on even date herewith;

U.S. patent application Ser. No. 10/274,511 entitled "METHOD AND SYSTEM FOR ADJUSTING PRECHARGE FOR CONSISTENT EXPOSURE VOLTAGE", filed on even date herewith;

U.S. patent application Ser. No. 10/274,502 entitled "METHOD AND SYSTEM FOR RAMP CONTROL OF PRECHARGE VOLTAGE", filed on even date herewith;

FIELD OF THE INVENTION

This invention generally relates to electrical drivers for a matrix of current driven devices, and more particularly to methods and apparatus for determining and providing a precharge current for such devices.

BACKGROUND OF THE INVENTION

There is a great deal of interest in "flat panel" displays, particularly for small to midsized displays, such as may be used in laptop computers, cell phones, and personal digital assistants. Liquid crystal displays (LCDs) are a well-known example of such flat panel video displays, and employ a matrix of "pixels" which selectably block or transmit light. LCDs do not provide their own light; rather, the light is provided from an independent source. Moreover, LCDs are operated by an applied voltage, rather than by current. Luminescent displays are an alternative to LCD displays. Luminescent displays produce their own light, and hence do not require an independent light source. They typically include a matrix of elements which luminesce when excited by current flow. A common luminescent device for such displays is a light emitting diode (LED).

LED arrays produce their own light in response to current flowing through the individual elements of the array. The current flow may be induced by either a voltage source or a current source. A variety of different LED-like luminescent sources have been used for such displays. The embodiments described herein utilize organic electroluminescent materials in OLEDs (organic light emitting diodes), which include polymer OLEDs (PLEDs) and small-molecule OLEDs, each of which is distinguished by the molecular structure of their color and light producing material as well as by their manufacturing processes. Electrically, these devices look like diodes with forward "on" voltage drops ranging from 2 volts (V) to 20 V depending on the type of OLED material used, the OLED aging, the magnitude of current flowing through the device, temperature, and other parameters. Unlike LCDs, OLEDs are current driven devices; however, they may be similarly arranged in a 2 dimensional array (matrix) of elements to form a display.

OLED displays can be either passive-matrix or active-matrix. Active-matrix OLED displays use current control circuits integrated with the display itself, with one control circuit corresponding to each individual element on the substrate, to create high-resolution color graphics with a high refresh rate. Passive-matrix OLED displays are easier to build than active-matrix displays, because their current control circuitry is implemented external to the display. This allows the display manufacturing process to be significantly simplified.

FIG. 1A is an exploded view of a typical physical structure of such a passive-matrix display 100 of OLEDs. A layer 110 having a representative series of rows, such as parallel conductors 111–118, is disposed on one side of a sheet of light emitting polymer, or other emissive material, 120. A representative series of columns are shown as parallel transparent conductors 131–138, which are disposed on the other side of sheet 120, adjacent to a glass plate 140. FIG. 1B is a cross-section of the display 100, and shows a drive voltage V applied between a row 111 and a column 134. A portion of the sheet 120 disposed between the row 111 and the column 134 forms an element 150 which behaves like an LED. The potential developed across this LED causes current flow, so the LED emits light 170. Since the emitted light 170 must pass through the column conductor 134, such column conductors are transparent. Most such transparent conductors have relatively high resistance compared with the row conductors 111–118, which may be formed from opaque materials, such as copper, having a low resistivity.

This structure results in a matrix of devices, one device formed at each point where a row overlies a column. There will generally be M×N devices in a matrix having M rows and N columns. Typical devices function like light emitting diodes (LEDs), which conduct current and luminesce when voltage of one polarity is imposed across them, and block current when voltage of the opposite polarity is applied. Exactly one device is common to both a particular row and a particular column, so to control these individual LED devices located at the matrix junctions it is useful to have two distinct driver circuits, one to drive the columns and one to drive the rows. It is conventional to sequentially scan the rows (conventionally connected to device cathodes) with a driver switch to a known voltage such as ground, and to provide another driver, which may be a current source, to drive the columns (which are conventionally connected to device anodes).

FIG. 2 is referenced to describe such a conventional arrangement for driving a display having M rows and N columns. A column driver device 260 includes one column drive circuit (e.g. 292, 294, 266) for each column. The column driver circuit 294 shows some of the details which are typically provided in each column driver, including a current source 284 and a switch 264 which enables a column connection 274 to be connected to either the current source 284 to illuminate the selected diode, or to ground to turn off the selected diode. A scan circuit 250 includes representations of row driver switches (208, 218, 228, 238 and 248). A luminescent display 280 represents a display having M rows and N columns, though only five representative rows and three representative columns are drawn.

Physically, the rows represented in FIG. 2 typically consist of a series of parallel connection lines traversing the back of a polymer, organic or other luminescent sheet, while the represented columns are typically constructed as a second series of connection lines, perpendicular to the rows and traversing the front of the luminescent sheet, as shown in FIG. 1A. Luminescent elements are established at each region where a row and a column overlie each other and thus form connections defining opposing sides of the element. FIG. 2 shows that each element as includes both an LED aspect (diode symbol) and a parasitic capacitor aspect (capacitor symbol "CP").

In operation, information is displayed row by row during successive row scan periods. During a row scan period, each column connected to an element of the row which is intended to emit light is driven. For example, in FIG. 2 a row switch 228 grounds the row to which the cathodes of elements 222, 224 and 226 are connected during a scan of Row K. The column driver switch 264 connects the column connection 274 to the current source 284, such that the element 224 is provided with current. Each of the other columns 1 to N may be concurrently providing current to the respective elements connected to Row K, such as the elements 222 or 226. All current sources are typically at about the same amplitude, and OLED element light output is controlled by varying the amount of time during which the element conducts. When an OLED element has completed outputting light, its anode is pulled low to turn off the element. At the end of the scan period for Row K, the row switch 228 will typically disconnect Row K from ground and apply Vdd instead. Then, the scan of the next row will begin, with row switch 238 connecting the row to ground, and the appropriate column drivers supplying current to the desired elements, e.g. 232, 234 and/or 236.

Only one element (e.g. element 224) of a particular column (e.g. column J) is connected to each row (e.g. Row K), and hence only that element of the column is connected to both the particular column drive (294) and row drive (228) so as to conduct current and luminesce (or be "exposed") during the scan of that row. However, each of the other devices on that particular column (e.g. elements 204, 214, 234 and 244 as shown, but typically including many other devices) are connected by the driver for their respective row (208, 218, 238 and 248 respectively) to a voltage source, Vdd. Therefore, the parasitic capacitance of each of the devices of the column is effectively in parallel with, or added to, the capacitance of the element being driven. The combined parasitic capacitance of the column limits the slew rate of a current drive such as drive 284 of column J. Yet rapid driving of the elements is necessary, as all rows must be scanned many times per second to obtain a reasonable visual appearance, allowing very little conduction time for each row scan. Low slew rates may cause large exposure errors, particularly for short exposure periods. Thus, for practical implementations of display drivers using the prior art scheme, the parasitic capacitance of the columns may severely limit drive accuracy.

A luminescent device matrix and drive system as shown in FIG. 2 is described, for example, in U.S. Pat. No. 5,844,368 (Okuda et al.). To mitigate effects of parasitic capacitances, Okuda suggests, for example, resetting each element between scans by applying either ground or Vcc (10V) to both sides of each element at the end of each exposure period. To initiate scanning a row, Okuda suggests conventionally connecting all unscanned rows to Vcc, and grounding the scanned row. The connection of all unscanned rows to a supply voltage, such as Vcc, effectively places the parasitic capacitance of all unscanned elements of the column line in parallel to the driven element. As such, changes in voltage on the driven element must also adjust the voltage on the combined column parasitic capacitance. The Okuda patent does not reveal any means to establish the correct drive level for a selected element at the moment of turn-on. The drive level required for display elements at a given current will vary as a function of display manufacturing variations, display aging and ambient temperature, and Okuda also fails to provide any means to compensate for such variation.

In view of the above, it may be appreciated that there is a need for a precharge process to reduce the substantial errors in OLED current which may result from employing a current drive for rapid scanning of OLED devices in a matrix having a large parasitic capacitance. Moreover, since the voltage for an OLED varies substantially with temperature, process, and display aging, a need may also be appreciated to monitor the drive levels of the OLEDs and to change the precharge process accordingly. Thus, what is needed in this industry is a means to adaptively apply correct precharging for scans of current-driven devices in an array.

SUMMARY OF THE INVENTION

In response to the needs discussed above, a method is presented for monitoring one or more matrix device conduction voltages, and adjusting a charge provided to precharge a matrix device connection on the basis of the monitored voltages, and for making a device to accomplish this. The invention may be embodied in many ways, only some of which are described in detail herein.

One embodiment may adaptively control a quantity of electrical charge provided to a matrix display connection during a target precharge period, and includes driving a current through a matrix element connected to a matrix connection during a conduction period, and deriving a control voltage from one or more voltages of a path of the driven conduction period current. A pre-exposure charge quantity to be delivered is adjusted based at least in part upon the derived control voltage, and the adjusted pre-exposure charge quantity is provided to the same or another matrix connection during the target precharge period.

Another embodiment may adapt precharge currents delivered to matrix element drive lines, and includes selecting an element for sampling, applying a previously established precharge current to the element during a precharge period, and driving a selected exposure current into a connection to the selected element during an exposure period of the scan cycle. The method also includes sampling a conduction voltage during the exposure period of the scan cycle, and basing a subsequent precharge current level for a matrix element drive line at least in part on the sampled conduction voltage.

A further embodiment may be used for making a circuit for controlling current drive to display elements. This embodiment includes configuring a plurality of exposure current sources to provide exposure currents to a corresponding plurality of display connections during exposure periods. The embodiment further includes switchably connecting a voltage sampling circuit, configured to obtain a plurality of sample voltages, to one or more conduction paths of the exposure currents, and configuring combiner circuitry to combine the plurality of sample voltages. Additional steps include switchably connecting a precharge current source to one of the plurality of display connections to supply current during a precharge period, and providing a control of the precharge current delivery which is responsive to a combination of the plurality of sample voltages.

Yet another embodiment may adaptively control electrical charge quantities provided to matrix display connections during precharge periods, by supplying a conduction current to matrix element connections during conduction periods, deriving a control voltage from one or more voltages of paths of the driven conduction period currents, adjusting a pre-exposure charge quantity based at least in part upon the derived control voltage, and providing the adjusted pre-exposure charge quantity to one or more matrix connections during a subsequent precharge period.

One aspect of the invention is related to an apparatus for driving current in devices of a matrix. The apparatus comprises a first driver circuit connectable to a first terminal of a matrix element to provide a current thereto. The apparatus also comprises a sink circuit connectable to a second terminal of the matrix element to accept current conducted by the matrix element. The apparatus may also comprise a sensing circuit configured to store a voltage developed when the matrix element conducts part of the current. The apparatus may further comprise a second driver circuit configured to output a quantity of charge which varies in response to the stored voltage.

Another feature of the invention is directed to an apparatus for controlling the supply of a current to a plurality of display elements. The apparatus comprises an exposure current source configured to provide a current to at least one of the display elements during exposure periods. The apparatus may also comprise a voltage sampling circuit configured to obtain a plurality of sample voltages from a conduction path of the exposure current. The apparatus may further comprise a sample voltage combiner configured to combine the plurality of sample voltages. The apparatus may also include a precharge circuit configured to change a precharge current level based at least in part upon the combined sample voltages.

In one embodiment, the invention concerns an apparatus for driving current in devices of a matrix. The apparatus comprises means for driving current to a matrix element during a conduction period. The apparatus further comprises means for receiving current from the matrix element. The apparatus may also comprise means for sensing a voltage developed when the matrix element conducts at least part of the conduction current. The apparatus may also further comprise means for outputting, during a precharge period, a quantity of charge which varies in response to a signal derived from the means for sensing the voltage.

BRIEF DESCRIPTION OF THE DRAWINGS

The foregoing and other features and objects of the invention will become more fully apparent from the following description and appended claims taken in conjunction with the following drawings, in which like reference numbers indicate identical or functionally similar elements.

DETAILED DESCRIPTION OF THE PREFERRED EMBODIMENT

The embodiments described below overcome obstacles to accurately generating a desired light output from an LED display. Certain obstacles to accurate light output generation are particularly pronounced in OLEDs, due to their relatively high parasitic capacitances, and to their high forward voltages which, moreover, vary with time and temperature. However, the invention is more general than the embodiments which are explicitly described below, being useful, for example, to enhance current delivery accuracy for any current-driven devices. As such, the invention is not limited by the specific embodiments, but rather is defined by the appended claims

Current Drivers and Need for Precharge

Figure 1B:
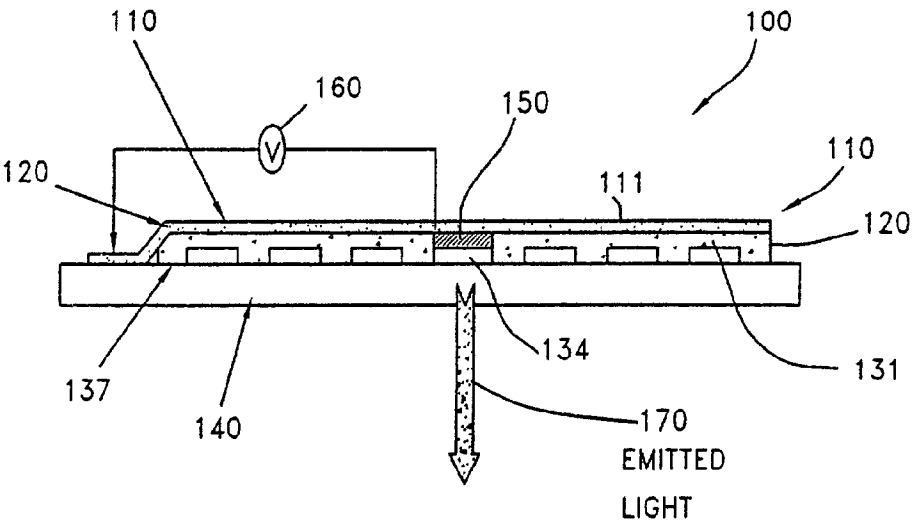
PRIOR ART FIG. 1B
FIG. 1B is a cross-sectional view of the OLED display of FIG. 1A.
Figure 1A:
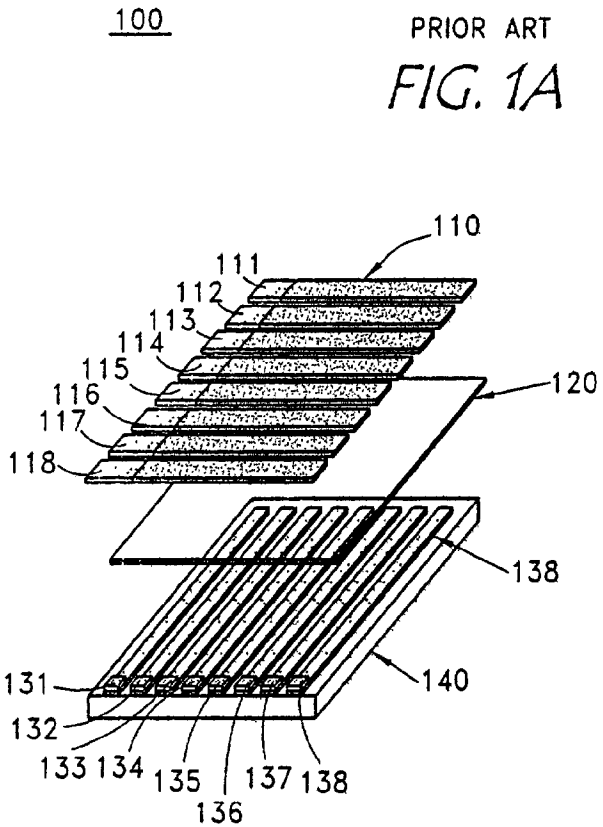
PRIOR ART FIG. 1A
FIG. 1A is a simplified exploded view of an OLED display.
Figure 2:
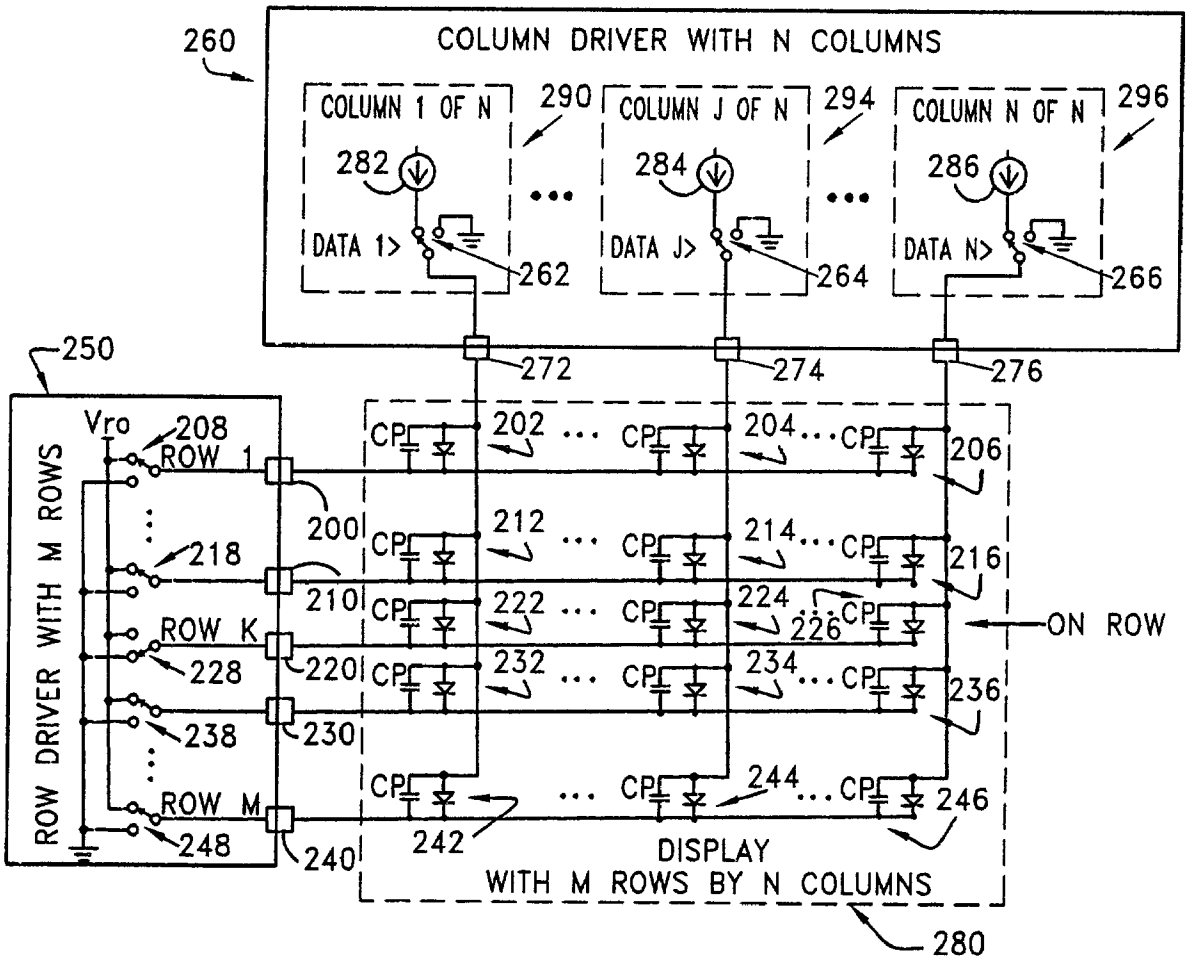
FIG. 2 is a simplified schematic diagram of an OLED display with device drivers.

Details of a passive current-device matrix and drive system are described with further reference to FIG. 2. Current sources, such as the current source 284, are typically used to drive a predetermined exposure current through a selected pixel element such as the element 224 to cause it to luminesce. However, the applied current will not all flow through an OLED element until the parasitic capacitance is first charged to the forward voltage of the OLED at that current. For example, the row switch 228 is connected to ground to scan Row K, but the entire column connection 274 must reach a requisite voltage in order to drive the desired current in element 224. The requisite voltage may be, for example, about 6 V, and the value varies as a function of current, temperature, and time. While driven by the current source 284, the voltage on the column connection 274 will move from a starting value toward a steady-state value, but not faster than the current source 284 can charge the combined capacitance Ccol of all of the parasitic capacitances of the elements connected to the column connection 274. In a typical display, for example, there may be 96 rows, and thus 96 devices connected to each column 274. Each device may have a typical parasitic capacitance value of about 25 pF, for a total Ccol of 2400 pF (96×25 pF). A typical value of current from current source 284 is 100 μA. Under these circumstances, the voltage will not rise faster than about 100 μA/2400 pF, or 1/24 V/μS, and will change even more slowly as the LED begins to conduct significantly. The result is that the current through the LED (as opposed to the current through Ccol) will rise very slowly when driven only by the current source 284 at a typical exposure current such as 100 μA.

Thus, a pixel element may not actually conduct the intended exposure current, even by the end of the scan period, if starting from a low voltage. For example, if an exemplary display having 96 rows operates at 150 frames per second, then each scan has a duration of not more than 1/150/96 seconds, or less than about 70 μS. At a typical 100 μA drive current the voltage can charge at only about 42 mV per μS (when current begins to flow in the OLED, this charging rate will fall off). At 1/24 V/μS, the voltage would rise by no more than about 2.9 V during the scan period, quite insufficient to bring a column conduction voltage Vc from 0 to a conduction voltage of 6V. Since the current source 284, at typical exposure levels, will be unable to bring an OLED from zero to operating voltage during the entire scan period in the circumstance described above, a distinct "precharge" period may be set aside during which the current source 284, or another current source device, drives a higher precharge current.

Typically, during precharge, the sink driver for a device, such as switch 228 in row driver 250, is connected to a higher source voltage Vro (row off voltage) which is high enough that the LED of a device (e.g., 224) does not conduct, but not so high as to exceed the matrix element reverse breakdown voltage. The value of Vro may, for example, be Vdd so that precharge currents are recirculated to the supply, or equal to column conduction voltage, or may be any voltage high enough to prevent significant current flow in any of the "off" devices, for example a value which is lower than the highest conduction voltage which will be seen by the columns by the lowest forward voltage Vf which might cause significant conduction. Since the row voltage Vro thus prevents forward bias of the matrix pixel element, the current delivered during precharge is accumulated on Ccol of the column elements (e.g., 204, 214, 224, 234 and 244) so that the connection (e.g., 274) achieves a certain precharge voltage by the end of the precharge period. The resulting voltage on the connection (274) is ideally that voltage which causes the OLED to achieve, at the beginning of its exposure period, the same voltage which it would reach after conducting the selected current long enough to achieve equilibrium. To keep the precharge duration short, a relatively high precharge current, for example between 1 and 10 mA, is generally preferred.

Normal Display Drive

Figure 3:
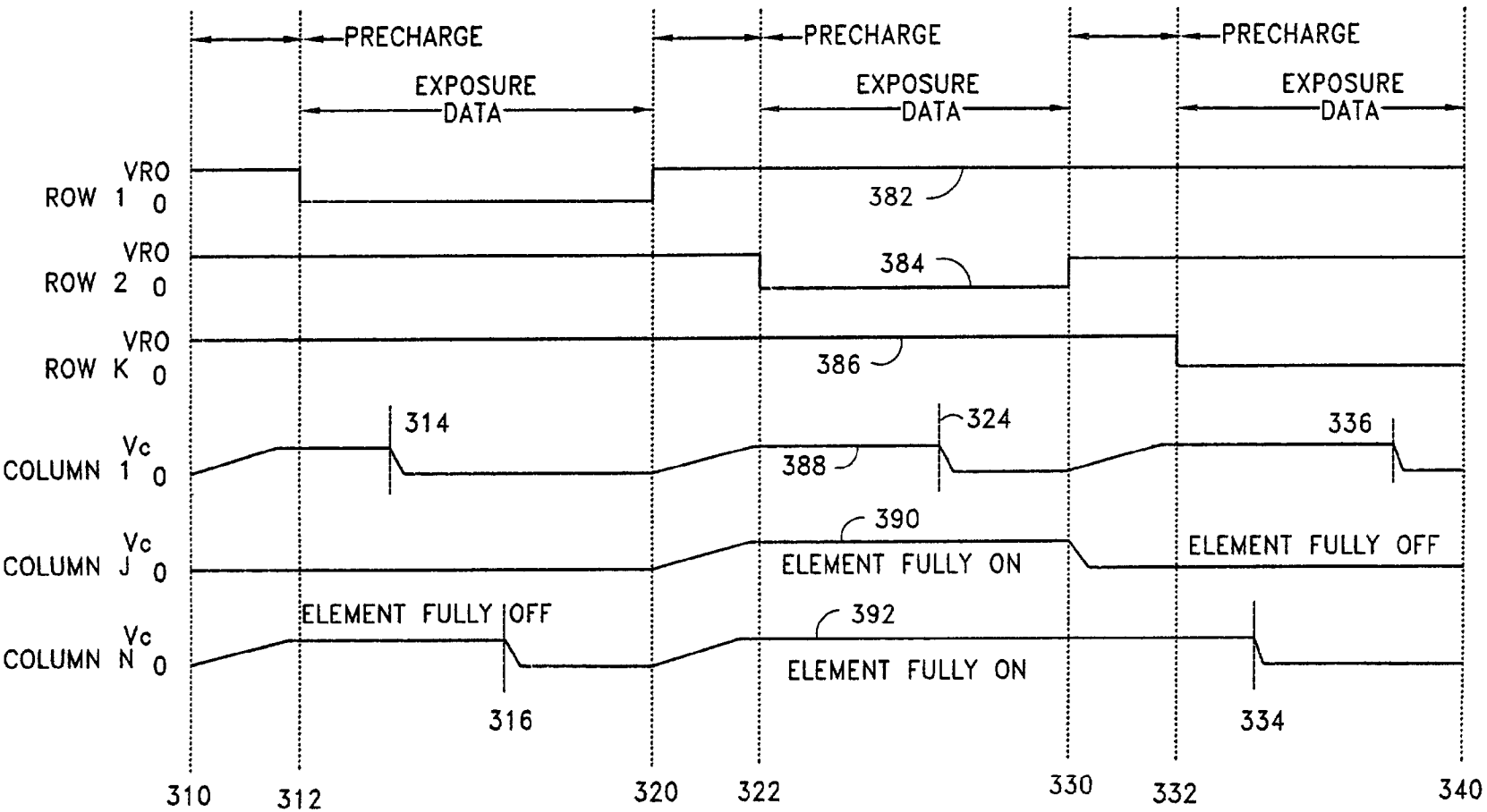
FIG. 3 is a waveform diagram for operation of several rows and several columns.

FIG. 3 provides illustrative waveforms reflecting basic timing relationships for some display device and driver embodiments. Reference is also made to FIG. 2 for representative circuit points at which the waveforms of FIG. 3 may be found. Reference numbers from 200 to 299 refer to FIG. 2, while reference numbers from 300 to 399 refer to FIG. 3. FIG. 3 covers three representative scan cycles, each having a precharge period and an exposure period, which extend from times 310 to 320, from 320 to 330, and from 330 to 340, respectively. During each exposure period, a row is "scanned" and exposure current is delivered, according to provided data, to the columns of those elements which will conduct current and luminesce during the period. Thus, the periods marked "DATA" are times during which an exposure may occur if so directed by the provided data. During the precharge period preceding each exposure period, the row typically remains off, but precharge current is provided to the same columns, if needed, to charge the parasitic capacitance of the column up to an exposure level. Details on this process follow.

During the first scan cycle, devices connected to row 1 (connection 200) may be exposed (i.e. may have current driven through them so that they luminesce). As indicated in the waveforms of FIG. 3, only columns 1 and N are exposed during the first scan, and column J remains fully off. In preparation for exposures of elements 202 and 206 during the first exposure period, precharge current is applied by current sources 282 and 286 to the column connections 272 and 276 during the first precharge period, which extends from the time 310 to a time 312. Waveforms 388 (column 1) and 392 (column N), representing the voltage on the connections 272 and 276, respectively, show that the voltage on both of these columns is rising from zero (or other low voltage) to the conduction value Vc (e.g., 6V) during the precharge period from 310 to 312. The rate of the voltage rise dV/dt is simply the precharge current Ipr divided by the cumulative parasitic capacitance Ccol attached to the column (e.g., 2.4 nF). If the precharge period duration is 6 μS, then to achieve Vc=6V from an initial 0V requires dV/dt=1V/μS, so that Ipr should be 2.4 mA in this case. (Note that Ipr need not be provided for the entire precharge period, as discussed in the Alternatives subsection of the Detailed Description.) The row waveforms 382, 384 and 386 (Row 1, Row 2 and Row K) which illustrate the voltage at connections 200, 210 and 220 respectively, show that all three of these rows remain at a high supply voltage (Vro) during the precharge periods, so that none of the OLED devices can conduct. A waveform 390 (column J) shows that the column voltage may remain at zero (or other low voltage—see Alternatives subsection at end of Detailed Description), since the device 204 will not conduct during the first exposure period. As such, no current is applied to column connection 274 during the precharge period.

The first exposure period begins at the time 312, when a switch 208 connects ROW 1 to ground (or other sink voltage). Accordingly, the waveform 382, which is at Vro everywhere else, drops to about zero for the duration of the first exposure, from the time 312 to the time 320. At the same time, the current sources 282 and 286 will be changed to a previously set exposure value (typically between 10 μA to 600 μA). Change from precharge current to exposure current may be accomplished either by modifying the current drive level of a current source such as the current source 282, or by switching to a different current source entirely (not shown). Since the row connection 200 is low, and the column connections 272 and 276 are high, current flows through the corresponding OLED devices 202 and 206. In order to vary the light output from these different devices, their exposure periods may be terminated at different times. For example, exposure current through the device 202 is terminated at a time 314, by switching a column drive switch 262 from the current source 282 (disabling the source) to ground (or other low voltage). Such discharge to a lower voltage brings the voltage on the column connection 272 rapidly down, as seen in the waveform 388 immediately after the time 314. At a later time 316, a column drive switch 266 is similarly switched from the current source 286 to ground, extinguishing the element 206 after an exposure length approximately twice that of the element 202. At the end of the first scan period, at the time 320, row connection 200 is again connected to Vro via a switch 208, as shown by the waveform 382 at the time 320.

The second scan cycle, during which devices connected to row connection 210 (row 2) may be exposed, begins at the time 320. The scan cycle begins with its precharge period, which extends from the time 320 to 322. As shown by the linear voltage rise across the precharge period from 320 to 322 in the waveforms 388, 390 and 392, all three columns receive a precharge current from a current source, e.g. 282, 284 and 286 respectively. During this period, the row switches (e.g., 208, 218 . . . 248) remain connected to Vro so that no devices conduct. This second precharge period ends when the subsequent (second) exposure period begins, at the time 322.

The second row is scanned during the second exposure period from the time 322 to the time 330, when the switch 218 connects row connection 210 (row 2) to ground. During this second scan period, columns 1, J and N are all active. Accordingly, the waveform 384 is zero during the exposure period, and otherwise is Vro. At the column 1 connection 272, the waveform 388 remains at an exposure voltage Vc during part of the exposure period, because the current source 282 is providing exposure current to the column connection 272 which is conducted by the element 212. At the time 324 the exposure of the element 212 is terminated by switching the column connection 272 to ground through the column switch 262, and the waveform 388 thus rapidly returns to zero. The waveform 390 remains at Vc throughout the exposure period, and then goes to zero as the column connection 274 is switched to ground through a switch 264. A column receiving a maximum exposure may be fully discharged during or before the beginning of the next precharge timing interval, as shown for Column J at the time 330 (the discharge may occur before precharge, as well). Alternatively, discharging a column after a maximum exposure may be delayed until the time that it is needed during the next cycle, as shown for Column N between the times 330 and 334. (A zero current may be delivered in this alternative by causing discharge to coincide with the beginning of row conduction, for example moving the discharge of Column N shown at the time 334 so that it coincides with, or slightly precedes, the time 332.) No precharge current is provided to column connection 274 during the scan period following this discharge, because this column does not conduct during the subsequent scan. The waveform 392, reflecting the voltage of a column connection 276, illustrates the case in which the element 214 of row 2 and column J is fully on, and thus remains at Vc from the time 322 to the time 330. An element 216 of the column J will be exposed during the next scan. However, in this case conduction through the element 214 is terminated by the row drive switch 218 connecting the row to Vro at the time 330, and accordingly the column connection 276 need not be discharged via the corresponding switch 266. Therefore, Ccol may be left fully charged, so precharge current need not be supplied during the subsequent precharge period from 330 to 332.

During the precharge period from 330 to 332 of the third scan cycle, the waveform 388 shows the linearly rising voltage on the column connections 272, 274 and 276 as they are precharged with a precharge current. The waveform 390 is reduced from Vc to about zero as the column connection 274 is discharged via the switch 266 in preparation for an absence of exposure, while the waveform 392 remains at Vc throughout the precharge period, during which the column connection 274 is neither discharged nor precharged, as discussed above. Alternatively, a maximum exposure may be terminated just prior to the end of a scan cycle, and all columns may be discharged at that time.

During the third exposure period from 332 to 340, the row K connection 220 is connected to ground via the switch 228, so the waveform 386 is about zero during this period. The waveform 388 remains at Vc during exposure, due to exposure current provided to the column connection 272 and conducted by an element 222, until the exposure is terminated at the time 336. The waveform 390 remains near zero, reflecting an absence of exposure current to the column connection 274 during this exposure period. The waveform 392 remains at Vc because exposure current is provided to the column 276 and conducted by an element 226 until exposure termination at a time 334.

Controlling Precharge Generally

With continued reference to FIG. 2, precharge is provided by a column driver (e.g., a column J driver 294) to cause the voltage on the parasitic capacitance Ccol of the corresponding column connection (e.g., the connection 274) to be initially correct when exposure current begins flowing in an element (e.g., 224), so that the exposure current does not begin either low or high. Initial errors would cause the element to conduct the wrong net charge during the exposure period, because part of the charge delivered to the column would be absorbed to correct the voltage on Ccol. Initial voltage errors have proportionally more effect when the exposure current is relatively low, and/or when the exposure duration is short, and can be reduced or eliminated by providing the correct quantity of charge to the column connection (e.g., the connection 274) during the precharge period to charge Ccol. The charge is typically supplied by driving a known current for a known duration, but see the "Alternatives" subsection in this regard.

Current sources, such as the current source 284 of a column driver 294, may encompass a variety of components, including one or more transistors configured to provide current at a high impedance. Since precharge currents are typically substantially higher than exposure currents, a column driver such as the column driver 294 may include separate precharge and exposure current sources.

Figure 4:
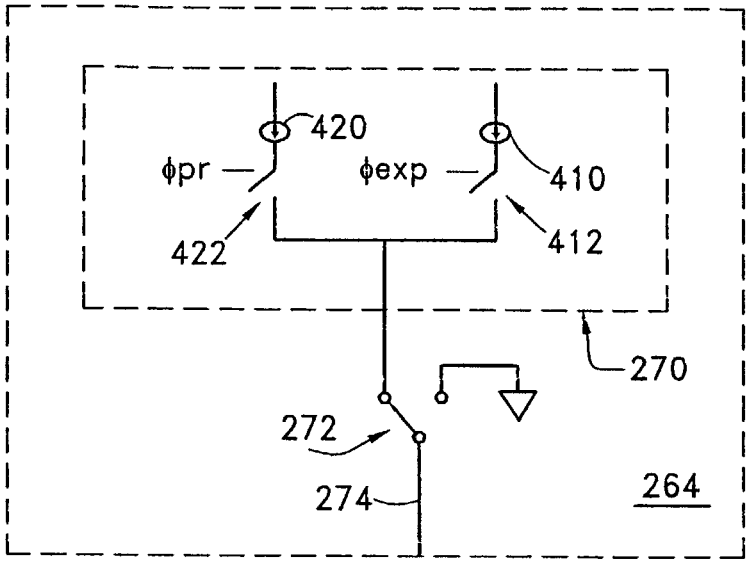
FIG. 4 is a block diagram of an exemplary dual driver column current source.

An implementation of the driver 294 which includes plural current sources is represented by the block diagram of FIG. 4. There, the current source 284 includes an exposure current source 410, connectable by a switch 412 which conducts during exposure periods (such as the period from 312 to 320 in FIG. 3), as well as a precharge current source 420 controlled by a switch 422, which conducts during precharge periods (such as the period from 310 to 312 in FIG. 3). The current source 284 is connected to the switch 264, which controls connection of the current source to the column connection 274 (as shown in FIG. 2). Exposure current from the source 410 is typically less than the precharge current from the source 420, in which case the switch 412 may be replaced with a direct connection so long as the current provided by the source 420 is reduced by the current from the source 410. Alternatively, the two switches 412 and 422 may be coordinated to connect the appropriate current source directly to the column connection 274, thus performing part of the function of the representative switch 272. Implementation of separate current sources as shown in FIG. 4 may, for example, reduce the range and complexity of the current control circuit for each individual current source; see the Alternatives subsection in this regard.

Figure 5:
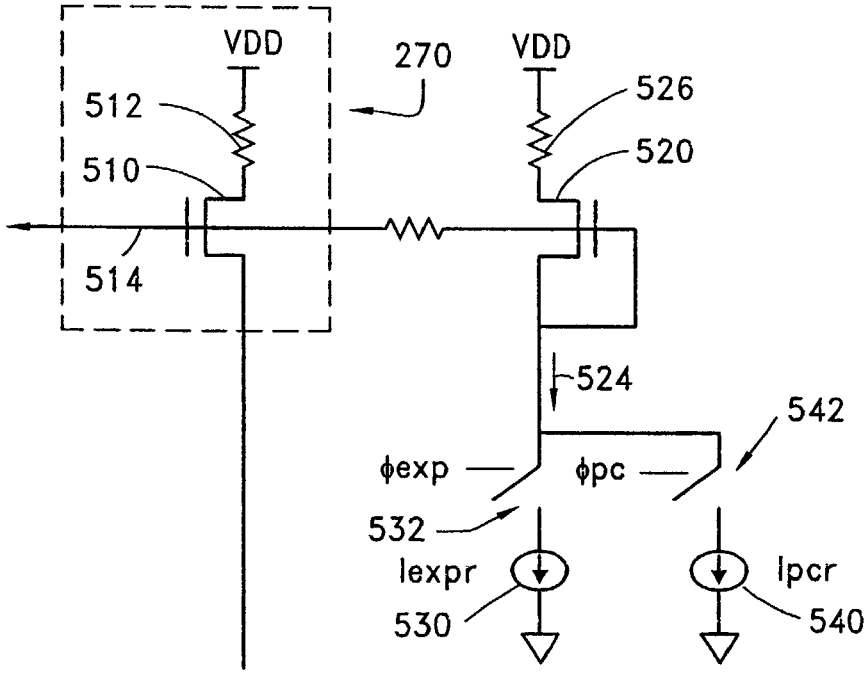
FIG. 5 is a block schematic diagram of single transistor column current control.

FIG. 5 schematically represents an alternative configuration for the driver 294 in which the current source 284 is implemented with a single FET 510 under control of two current-setting circuits. The FET 510 typically has a drain resistor 512. A gate connection 514 is coupled via a resistor 522 (which may be essentially zero ohms) to a current mirror FET 520 which controls a voltage provided to the gate 514 to cause the current of the current source 284 to be related to a drain current 524. The relationship will be based in part on the relative geometry and drain resistance of the two FETs 510 and 520, as is known in the art. The drain current 524 in turn is set by an exposure current reference Iexpr 530 when a switch 532 (under control of exposure signal (Φexp) is closed, and by a precharge current reference Ipcr 540 when a switch 542 (under control of a precharge control signal Φpc) is closed. The switch 532 may be closed only during the exposure period, and the switch 542 may be closed only during the precharge period. In that case the current of the reference 540 will be related to the current of the reference 530 substantially as the desired precharge current is related to the desired exposure current. Many configurations of switches are acceptable; for example, if the power consumed by constant conduction of the current source 530 is negligible, and assuming that the magnitude of the current source 540 is reduced accordingly, then the switch 532 may be replaced by a straight connection.

The exposure current reference 530 (Iexpr) is typically adjustable to change the overall brightness of the display. The current may be provided, for example, by a current DAC controllable by digital bits latched from a process controller (not shown), or may be provided by a current reference input to the overall driver chip (not shown), controllable by any means, such as a potentiometer. Control of the precharge current reference 540 (Ipcr) may adapt to changing conditions of the display elements, such as age and temperature, according to one of several methods such as explained below. When considering these methods, the skilled person will understand, first, that the circuits can be implemented by an unlimited range of particular components. In particular, note is made that the presence of current source degeneration resistors may often be avoided, and that current source transistors may be implemented in a well-known cascade configuration, particularly to handle somewhat higher voltages. Such variations are not described in detail, in order to avoid obscuring the principles of the circuits, which are primarily illustrative.

Predictive Precharge Current Based on Periodic Calibration

Figure 6:
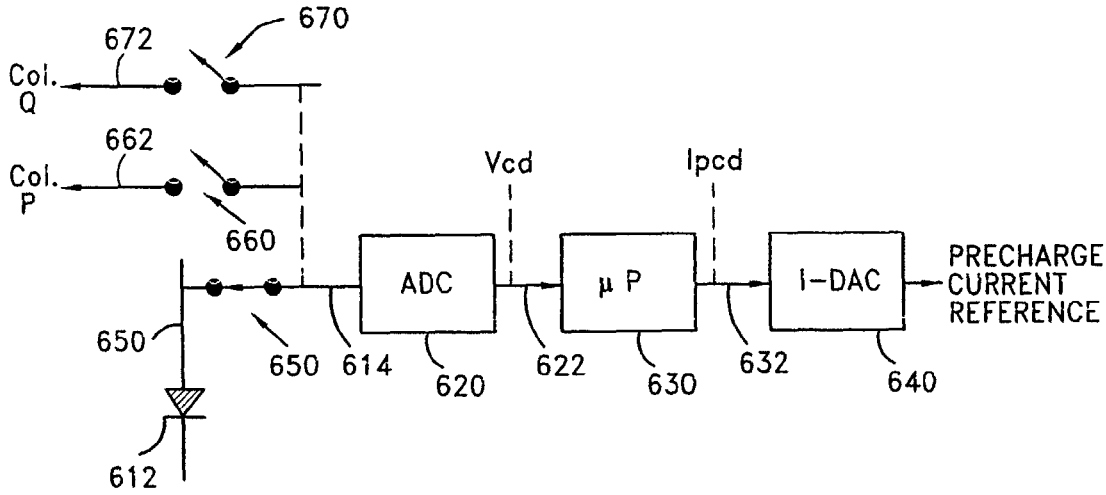
FIG. 6 is a block diagram for digital precharge sense and predictive current control.

FIG. 6 is a block diagram of circuitry to obtain a column conduction voltage Vc. A particular column driver device, such as the device 290 of FIG. 2, may include a means to measure one or more voltages of an exposure current conduction path of a display device, such as the device 224 of FIG. 2. Such voltages may be caused by currents supplied to a column connected to the display device, particularly precharge and exposure currents. For example, a measurement of a present column conduction voltage Vc during an exposure may be used to predict the quantity of charge which is best adapted for precharge under the present conditions of the display devices.

An active column line 610, conducting current to a particular display device 612, may be coupled so as to provide the corresponding column voltage Vc to an ADC 620 which will then provide a digital representation of Vc, Vcd 622, to a processor 630, where it will be stored in memory (not shown). The voltage resolution, accuracy and range of the ADC 620 may, for example, be about 12 mV, 25 mV and 2–14 V, respectively, for predicting and setting precharge currents. After manipulating Vcd 622 in view of other information, the processor 630 will provide a digital value for a desired precharge current, Ipcd 632, to a current DAC 640.

With a connection to a single column line 610, a Vc for any display device connected to that column may be measured by merely activating the row corresponding to the device. As many different columns as desired may be measured by duplicating the ADC 620 for each column to be sensed. However, even though a single processor may collect the digital representations Vcd from each ADC, this approach may be somewhat expensive in terms of component count or device chip area.

Alternatively, a single ADC 620 may be switched to measure Vc for different columns by disposing a switch 650 between the active column 610 and the ADC, and coupling a Vc from a different column P 662 via a switch 660, or a Vc from a yet different column Q 672 via a switch 670. Switches such as 650, 660 and 670 should be closed one at a time, and may be provided for connection to any number of columns from 1 to N, where N is the number of columns driven by a particular driver device such as 290 (FIG. 2). Switches such as 650, 660 and 670 may, in a further alternative, connect the input of the ADC 620 to capacitively stored samples from different columns, rather than directly to the column connections. This further alternative permits concurrent sampling of Vc from any number of columns, and also permits averaging of such measurements by simultaneously connecting the corresponding switches.

For the columns of which Vc will be measured, any combination of the foregoing alternatives is appropriate, such as employing a corresponding ADC for groups of sixteen columns, and providing switches to the corresponding ADC from some or all of the sixteen columns in the group. Depending upon design details, providing more than one different ADC for different columns may impair relative accuracy between the different columns, but may have an advantage of reducing the time required to measure all of the desired columns. However, even if a single ADC is used, relative accuracy between different columns which are sampled simultaneously may be affected by varying droop in the sample capacitor. To reduce storage time (and therefore droop), a plurality of ADCs like the ADC 620 may each be connected to a single corresponding column.

Figure 7:
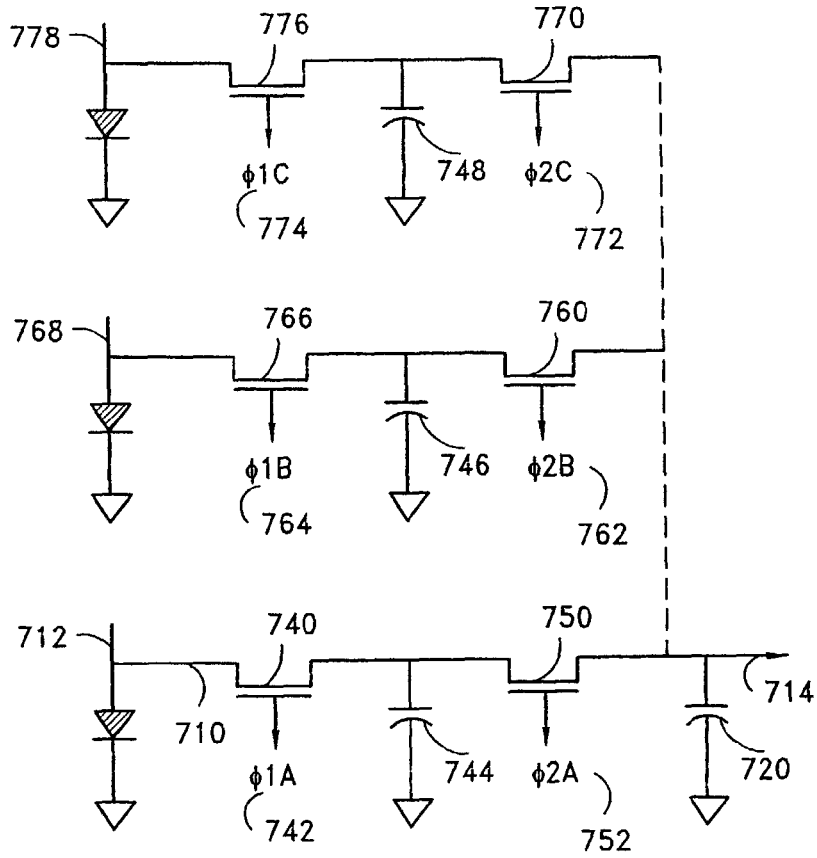
FIG. 7 is a diagram of sampling circuits for digital sensing as in FIG. 6.

FIG. 7 is a block-level schematic diagram of a two-step sample and hold circuit connected to a column connection 710, for sampling a voltage on a matrix device 712. The connection 714 may be connected to an ADC such as shown in FIG. 6, in place of the connection 614. (A mixed system having both direct measurement, as shown in FIG. 6, and sampled measurement in accordance with FIG. 7, may also be employed.) A hold capacitor 720 may be omitted when providing samples to an ADC such as shown in FIG. 6, or may be employed as a means of averaging sampled values over time or between different elements.

A column conduction voltage Vc may be established at the connection 710 during a special conduction cycle by simply causing a known exposure current level to flow continuously through the element 712 until the voltage stabilizes at an equilibrium value. While conduction continues, sample switch 740 may be closed during a time $\Phi_{1A}$ 742, such that Vc is stored on a sample capacitor 744. A transfer switch 750, closed during a time $\Phi_{2A}$, may function like the switches 650, 660 or 670 shown in FIG. 6 to bring the voltage stored on the sample capacitor 744 to an ADC.

Additional columns may be sampled. Vc samples may be provided to other sample capacitors, such as 746 and 748, during an appropriate sample period $\Phi_{1B}$ 764 or $\Phi_{1C}$ 774, respectively, when the corresponding sample switches 766 and 776 are closed. The Vc samples thus stored may be connected to the common sample connection 714, for example via a transfer switch 760 during a time period $\Phi_{2B}$, and via a transfer switch 770 during a time period $\Phi_{2C}$. The time periods $\Phi_{2A}$, $\Phi_{2B}$ and $\Phi_{2C}$ may be mutually exclusive, such that in the absence of the hold capacitor 720, an ADC connected to connection 714 can measure each element's voltage individually. Alternatively, any group of such transfer switches may be connected simultaneously to average the Vc values over such group. For example, average Vc for groups of eight columns may be measured by an ADC. Moreover, if switches 740 and 750 are closed simultaneously, then connection to a column is established as if by the switches 650, 660 or 670 in FIG. 6. Thus, circuits like those of FIG. 6 and FIG. 7 may be employed to obtain individual values of Vc, or values of Vc averaged over any combination of matrix elements, during a calibration period.

In order to predict the correct value for the charge to be delivered during precharge, information on the total parasitic capacitance Ceol on each column will be helpful. Ccol may, for example, be determined and stored permanently when the display device is manufactured, or it may be determined as needed by observing a rate of column voltage change during application of a known current. It will also be useful to have a value for the column discharge voltage Vdis which is present at the beginning of precharge periods. Referring momentarily to FIG. 2, column drive switches such as the switch 264 may discharge the column voltage to a value Vdis which is not zero (and indeed may range to several volts under some conditions), but which is low enough to terminate significant conduction through matrix devices. The discharge voltage Vdis may be determined during manufacturing, or it may be measured by sampling the column voltage after an exposure and just prior to the subsequent precharge period. Thus, $\Phi_{2A}$ may be set to extend from (referring momentarily to FIG. 3) a termination of exposure time 324 until just prior to the subsequent precharge period at the time 320. For obtaining Vdis, the sample period $\Phi_{1A}$ need only be long enough to fully charge the sample capacitor, e.g. 744 in FIG. 7, and $\Phi_{1A}$ may end any time after the termination of an exposure when the discharge voltage has settled to essentially the value it will have at the beginning of the subsequent precharge period.

After a calibration cycle, the correct charge for precharge may be recalculated in accordance with the formula $\Delta Q = \Delta V * Ccol$. $\Delta Q$ is the charge to be applied to Ccol during precharge, and $\Delta V$ is the desired change in column voltage from Vdis to Vc. Delivery of $\Delta Q$ may be controlled by controlling either or both of a duration and a level of precharge current during the precharge period. Returning to FIG. 6, the processor 630 may provide a digital representation of the desired current to the current DAC 640. Additionally, or alternatively, a switch such as the switch 422 in FIG. 4 may be digitally controlled to provide precharge current for a reduced portion of the precharge period, as described with respect to FIG. 10. Indeed, precharge current may be set to a fixed value, and the charge delivered to each column for precharge may be controlled exclusively on the basis of conduction time. For current value I and precharge delivery time T which are constant, I and/or T may be derived from the equation Q=I*T. If variable precharge currents i(t) are used, the calculation may integrate i(t) over T, for example by piecewise linear approximation.

Once the correct value of precharge current is determined, it may be reduced to allow for other currents known to be provided during precharge. For example, if the column exposure current Iexp is provided in parallel with the precharge current, then the current DAC 640 should provide the calculated precharge current reduced by Iexp. Thus paralleling Iexp with Ipc could save a switch in each column drive circuit which is constructed with separate Iexp and Ipc source transistors as shown in FIG. 4.

Sampling of Vc may be performed near a beginning of exposure conduction periods to confirm that the column voltage Vc at that time matches the measured equilibrium value. The algorithm for predicting precharge current may be adjusted to eliminate any discrepancy, resulting in predictive/adaptive hybrid precharge control.

Adaptive Current Control—Digital

The pre-exposure charge delivered during precharge periods may be either predictively or adaptively based upon measurements made during normal operation. Pre-exposure charge thus based on normal operating parameters may be more or less continuously adapted.

First, an equilibrium value may be deduced for column conduction voltage Vc of the connection 710 during normal operation, and that equilibrium value may then be used to predict a correct precharge current as explained in the previous subsection. The equilibrium value may be determined iteratively by measuring Vc, improving precharge, and repeating. A first Vc may be measured at the end of exposures of a particular selected matrix display element. A pre-exposure charge (to effect precharge) may be predicted from that value (as if it was the equilibrium voltage) and delivered subsequently to the same pixel, with Vc measured during other exposures. Equilibrium may be deduced when Vc measured at the end of a short exposure (or a short time into an exposure) is equal to Vc measured at the end of a long exposure. The equilibrium value thus determined may then be used as an accurate predictor value for pre-exposure charge, as described above. Of course, this technique may also be used to constantly update the equilibrium value and the pre-exposure charge prediction, at some cost in processing power.

Adaptive precharge control may be accomplished in other ways. If exposure current Iexp is constant, then changes in Vc from the beginning to the end of an exposure period generally indicate that the initial column voltage, which is due to precharge, does not match the steady state voltage which the device would achieve by conducting the exposure current until reaching equilibrium. Therefore, such differences between initial and final Vc during an exposure may provide a basis for adaptively adjusting the quantity of charge delivered during precharge.

Such an adaptive scheme may be implemented with a digital ADC/DAC system as shown in FIG. 6, particularly in conjunction with a sample and hold circuit such as shown in FIG. 7. With reference to FIG. 7, the sample time $\Phi_{1A}$ may be set to correspond to the beginning of an exposure period following a normal precharge, for example the first 2 μS of an exposure period, during which the sample capacitor 744 may be charged to a first conduction sample value Vcs1. The hold capacitor 720 is omitted. The connection 714 may be connected to the input of an ADC. An active period for $\Phi_{2A}$ 752 may begin just after $\Phi_{1A}$ becomes inactive, causing the transfer switch 750 to pass the first column sample voltage Vcs1 to the ADC to produce a first digital representation Vel of sample voltage Vcs1. For an ADC with a conversion time several μS shorter than the exposure conduction period, $\Phi_{2A}$ may be made inactive before the exposure conduction period ends. In that event, $\Phi_{1A}$ may again be made active after $\Phi_{2A}$ becomes inactive, enabling the switch 740 and causing a second column voltage sample Vcs2 to be established on the sample capacitor 744. After a $\Phi_{1A}$ active period sufficient to fully charge the sample capacitor, $\Phi_{1A}$ is again made inactive, preferably just before the end of the exposure conduction period. The sample of Vc at the end of the exposure period, Vcs2, may then be provided to the ADC by making $\Phi_{2A}$ active, such that a second digital representation Vc2 may be obtained. However, for slow ADCs or short exposure periods, Vcs1 may be sampled by a first sample switch (e.g., 740) and first sample capacitor (e.g., 744), while Vcs2 is obtained at a later time by a separate sample switch (e.g., 766), whose connection 768 is also connected to the column connection 710. The sample capacitor 746 may then hold the Vcs2 sample until the ADC completes conversion of the Vcs1 sample.

The processor may then adjust the boost charge, which was a known first value Q1, to a second value Q2 on the basis of the acquired digital values Vc2 and Vc1 according to an equation (Q2−Q1)/Q1=G*(Vc2−Vc1)/Vc1. G is a selectable gain value, and should be a positive number in the circuit described. G may be adjusted to give stable loop control and an acceptable loop time constant for an entire range of variables anticipated in a particular design. Since increasing G increases loop response speed, G may be made a function of one or more operation parameters. For example, G may be varied generally inversely with exposure current to obtain faster response at low values of exposure current. The best G value for a system will depend upon the response speed needed, as well as any lag due to averaging of Vc2 and Vc1 with previous values. Faster response may also be obtained by measuring Vc1 and Vc2 more frequently, such as each scan cycle.

In accordance with the foregoing, the boost charge provided to Ccol before each exposure may thus be adapted to initialize Vc to the equilibrium value for the selected exposure current, such that Vc does not change significantly during the exposure.

Various alternatives and refinements are possible. In one example, $\Phi_{1A}$ 742 may be set to end at the same time, or just before, the precharge period ends, thus capturing the voltage value at the end of precharge. However, such a measurement will permit certain errors, due for example to a step change in the voltage of a column when a row is switched from an off voltage to an "on" voltage. Another error is the transient potential induced by the precharge current through the column resistance. In another refinement, the processor may average the difference value (Vc2−Vc1) for a number of device exposures and/or over time. Other refinements may be employed to allow for the Vc slew rate limit d(Vc)/dt=Iexp/Ccol, including increasing gain inversely to Iexp and giving more weight to Vc2−Vc1 separated by less time (i.e., resulting from shorter exposures). The processor may also take actual sample rate, as well as the number of devices over which the sample value is averaged, into consideration. Thus, for example, the processor may stop adjusting the precharge Q value when few elements can be sampled, or when the sample rate is very low. The processor may also compensate for differences between individual elements by observing a pattern of lower pre-exposure charge requirements for some elements, and reducing the duration of precharge conduction for those elements.

Adaptive Current Control—Analog

Figure 8:
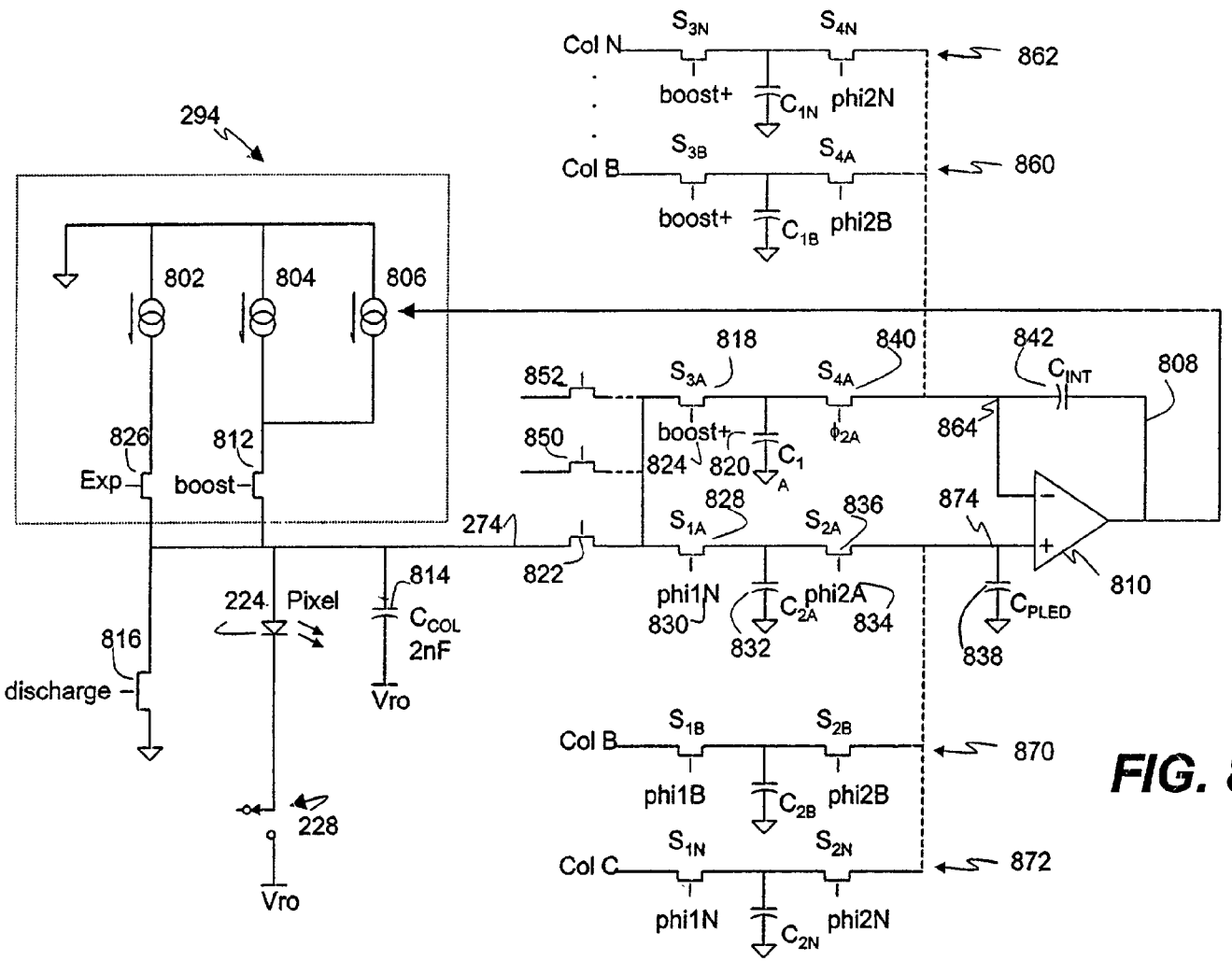
FIG. 8 is a simplified schematic diagram of a boost current adaptive control circuit.

FIG. 8 is a schematic diagram of an analog boost current adjusting circuit. This circuit adjusts a precharge current based upon a comparison between column voltages at the beginning of exposures, and column voltages at the end of exposures.

A representative current drive control circuit 294 (of column J in FIG. 2) is described in FIG. 8, but other current drive control circuits would typically be similarly constructed. The current control circuit 294 may include three distinct current sources: a current source 802 for exposure current Iexp, a current source 804 for a basic boost current, and a current source 806 which controllably provides additional boost current in accordance with a voltage output 808 of an integrator 810. Any suitable technique for controlling a current source such as the source 806 based on a voltage such as 808, whether now known or later developed, may be used for this purpose. As one example, the output voltage 808 may be connected the same as is the output 952 in FIG. 12, with each item 1274, 1276, 1278, 1280, 1282, 1284, 1286, 1288, 1290, 1292, 1294, 1296, 1298 and 1266 used the same way as is described with respect to FIG. 12.

During a precharge period, a boost switch 812 connects the boost current sources 804 and 806 to a column connection 274 having an effective cumulative parasitic capacitance Ccol 814. Ccol represents the cumulative capacitance of the inactive matrix elements of column 274, which have their cathodes connected to unused row lines which are terminated to Vro, which in turn is an effective ground for transient purposes. At this time the representative row switch 228 connects device 224, corresponding to the one active matrix element, to Vro as well. The discharge transistor 816 is typically closed prior to the precharge period, discharging the column capacitance Ccol 814 to establish a ground potential on the column connection side and Vro on the row connection side of Ccol 814. During the boost current conduction period the switch 816 is open, and current from the sources 804 and 806 raise the voltage Vc at the connection 274. Also during this period a selection switch 822 and a boost sample switch 818 may be closed to acquire Vc on a sample capacitor C1A 820. Switch 818 is controlled by a signal "boost+" 824, which is preferably active (closing the switch 818) by the end of the boost period, or earlier. At the end of the boost precharge period, the signal "boost+" 824 becomes inactive and the boost current switch 818 is opened, leaving a sample of Vc "boost" ("Vcsb") on the sample capacitor 820.

To begin an exposure during which the matrix device 224 actually conducts current, an exposure switch 826 provides Iexp to the column connection 274 and the switch 228 connects the row side of device 224 to ground. However, the device 224 includes its own parasitic capacitance Cp. (For M devices in the column, Cp may be one of M approximately equal capacitances lumped into Ccol 814, and thus Cp may be about 1/M*Ccol.) Switching the cathode terminal of device 224 from Vro to ground by the switch 228 may cause a switching transient disturbance on Vc of about −Vro*Cp/Ccol, though in most cases the distributed nature of Ccol and the column resistance will substantially attenuate this transient. Another switching transient, which may be referred to as a "boost current termination" transient, occurs due to collapse of voltage in the column resistance upon termination of the boost current. In order to reduce effects of these, or other, transients on the operation of the boost current control, the switch 818 may be adjusted to remain closed after the beginning of the exposure period until the switching transients have settled, generally within ¼ to 4 μS. Thus, the active period for the "boost+" signal 824 preferably extends slightly beyond the boost period. Further extending the "boost+" signal active period beyond the transient period will begin to reduce sensitivity of the circuit. The sample voltage Vcsb remains on the capacitor C1A 820 when the switch 818 opens at the end of the "boost+" active signal.

During the exposure, an exposure sample switch 828 is closed under control of a signal phi1A 830, after switch 818 has opened. Switch 828 connects the voltage Vc on the column connection 274 to an exposure sample capacitor 832. Switch 828 opens at or slightly before the end of the exposure period, leaving an "exposure" sample voltage Vcsx on capacitor C2A. This occurs before the discharge switch 816 actively extinguishes the exposure by grounding the column. If the precharge boosted column voltage Vc "boost" at the beginning of the exposure is below an equilibrium conduction voltage for the device 224 (plus other device drive circuit elements) when conducting Iexp 802, then Vc at the end of the "exposure" will be higher due to the device 224 and the Ccol 814 conducting Iexp for some exposure duration. Conversely, if Vc "boost" at the beginning of the exposure exceeds the equilibrium conduction voltage for the device 224 (plus other device drive circuit elements) when conducting Iexp 802, then Vc at the end of the exposure will be lower than Vc "boost," due to the device 224 and the Ccol 814 conducting both Iexp and part of the charge from Ccol during the exposure.

A signal phi2A 834 controls a switch 840 to transfer the sample on C1A to the integrator summing node 864, and may also control a switch 836 to transfer the sample on C2A to an integrator reference node, 874. Signal phi2A should generally not be active if phi1A is active, and may be the non-overlapping inverse of the signal phi1A. The switch 836 causes the "exposure" sample Vcsx of the sample capacitor 832 to be averaged with previous Vcsx values, as stored on a reference storage capacitor 838, which thus holds an average value Vcsxa of Vcsx values. The reference storage capacitor may be about one to ten times the value of the sample capacitor 832; larger ratios will slow system response commensurately. With the reference voltage established at node 874, the switch 840 causes the difference between the sample taken on capacitor C1A at the beginning of the exposure, and the running average of samples taken on capacitor C2A at the end of exposure, to be integrated on capacitor 842. Thus, the voltage at the output integrator 810 represents the integrated value of the difference of samples on capacitors C1A 280 and C2A 832.

To accurately accomplish this integrating action, the signal phi2A may be made non-overlapping with both the "boost+" signal 824 and phi1A 830. However, the switches 834 and 840 need not be active at identical times, as long as their individual activity is non-overlapping with their respective sample switch signals. This is valid because the reference input 874 to the amplifier 810 represents an average of the samples on C2A. Each time the switch 840 is closed, the difference between Vcs "boost" (Vcsb) and Vcsxa present on the capacitor 838 is integrated (inversely) by the integrator 810 in accordance with the value ratio of an integration capacitor 842 and the sample capacitor 820. The boost current control voltage 808 will vary proportionally to (Vcsxa-Vcsb), thus raising the boost adjust current 806 when the average end of exposure value Vcsxa exceeds the value from the beginning of exposure, Vcsb.

Because differences between "boost" and "exposure" values determine adjustments to the current of boost adjustment current source 806, longer exposure periods provide a larger signal for controlling the boost current by permitting more change in Vc during the exposure. Accordingly, the circuit gain is partly proportional to an average exposure duration between Vcsb sample times and Vcsx sample times for the sampled elements, and it may therefore be useful to sense only elements which will be exposed for more than a selected minimum exposure time. Compared with each other, Vcsb samples are taken closer to boost (e.g., at boost+), and Vcsx samples are taken during exposure closer to the end of exposures. The difference between their timing should permit a distinguishable difference in sample voltage when boost establishes a Vcol differing significantly from the equilibrium value, but there is no requirement that the Vcsb and Vcsx samples be taken as close as possible to the "early" end and the "late" end, respectively, of exposures. Thus, for example, if it is desirable to equalize sensitivity to each measured element, it may be useful to close the "exposure" sample switch (e.g., 828) for each element at the same selected minimum time rather than as late as possible, although this may reduce overall sensitivity.

A variety of other columns may be sampled for differences between early and late, or "boost" and "exposure" voltages. For example, switches such as 850 and 852 may be provided to connect the sample switches 818 and 828 to other columns, generally to only one column at a time. The circuit may thereby be configured to sample any one of the columns during a particular conduction cycle.

In order to sample more than one column concurrently, further "boost" sample circuits such as 860 and 862, which are typically configured similarly to the boost sample circuit comprising the switches 818 and 840 and the sample capacitor 820, may be connected to additional columns (such as columns B and N) and to an integration junction 864. Likewise, additional "exposure" sample circuits, such as 870 and 872, typically configured similarly to the exposure sample circuit comprising the switches 828 and 836 and the sample capacitor 832, may be connected to the same additional columns (B and N) and to an exposure junction 874. The integration ratio of the integration capacitor 842 value to the sum of "boost" sample capacitances will proportionally affect the averaging of the "boost" signal sample with preceding samples, and will inversely affect control loop gain. As a starting point, the integration ratio may be selected to be about four. The exposure average ratio of the exposure averaging capacitor 838 value to the sum of all "exposure" sample capacitance values may be made the same as the integration ratio. The voltage to current gain d(boost adjust current 806)/d(boost adjust control voltage 808) is also a proportional gain term.

Each of the "boost" sample circuits may be connected, for any particular scan cycle, to a selected column via column selection switches configured similarly to the column selection switches 822, 850 and 852 as discussed above. Thus, for example, the three boost sample circuits shown (circuits 860, 862 and 818/820/840) may each be connected to sample one of eight columns to which it may be switched by a selection switch such as the switch 850. The column to be sampled may be selected on the basis of the length of exposure which has been programmed for the column, and the three resulting samples may be averaged together as shown. The boost adjust control voltage 808 may thus be derived from any selection or combination of columns, and may have sample averaging over a controllable range of preceding samples and a controllable range of concurrent samples. The boost adjust control voltage 808 may be used to control boost current in any number of columns, from one to N.

Ramp Current Control

Figure 9:
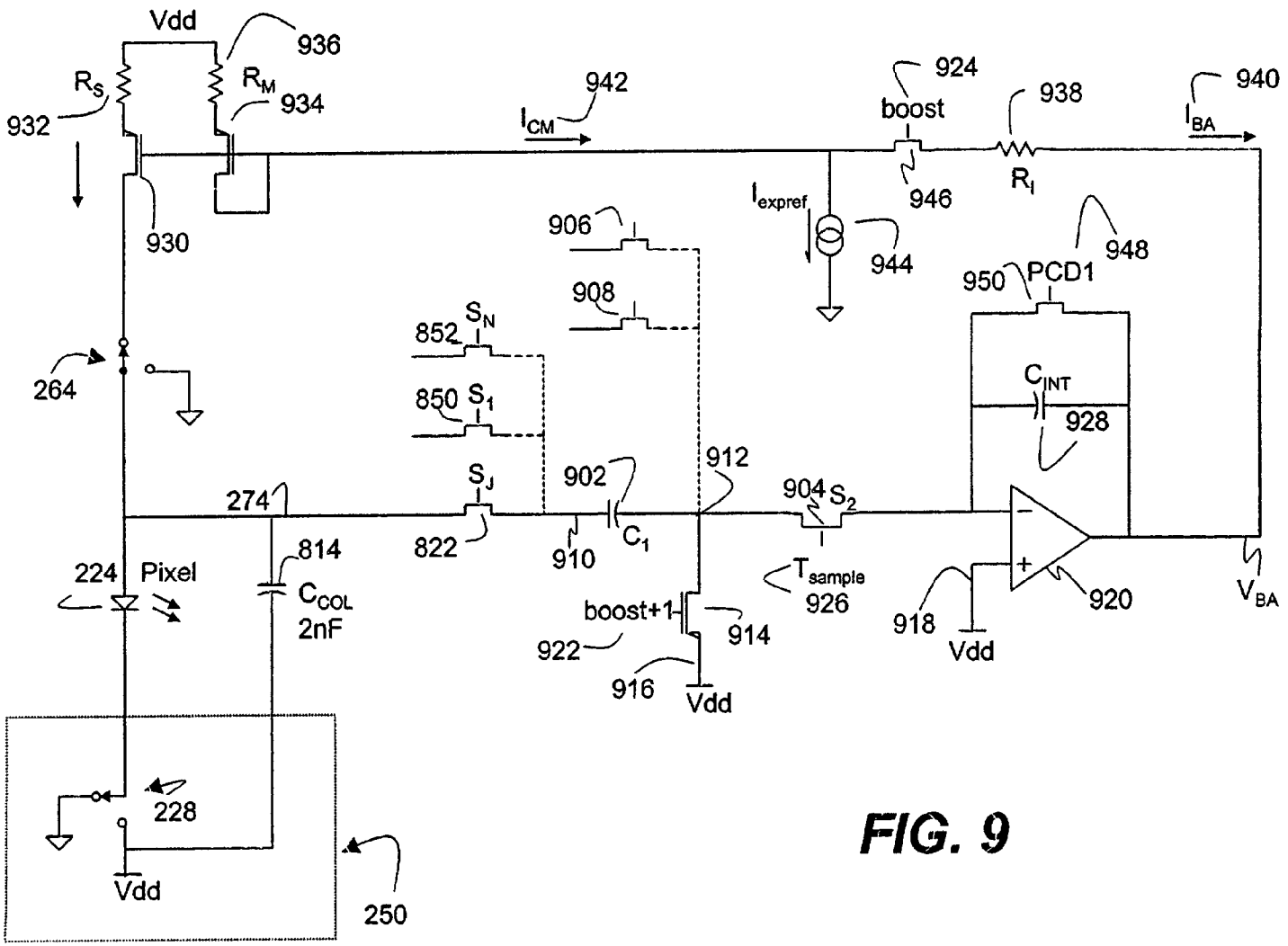
FIG. 9 is a schematic representation of a ramp-based adaptive boost current circuit.

FIG. 9 schematically illustrates another embodiment for adjustment of boost current. This "ramp" method is based upon changes in column conduction voltages Vc during exposure as before, but sensed as a voltage "ramp" or change during a single exposure, as sensed via a sensing capacitor 902. As an additional variation, the ramp method as presented here illustrates using a single current source transistor for both boost and exposure current for a column. As in FIG. 8, the representative element 224 is the active device, with a Cp which is parallel to the column capacitance Ceol 814. The column connection 274 may be coupled, via a ramp sense capacitor 902, to a ramp integration circuit 900 which integrates the current through the ramp sense capacitor 902 while a ramp sample switch 904 is closed.

A sense column connection 910 of the ramp sense capacitor 902 may further be coupled to the column connection 274 through a selection switch 822, permitting selective connection of the sense column connection 910 to one of a variety of columns through selection switches, such as the optional selection switches 850 and 852, in a similar manner as described above with respect to FIG. 8. Moreover, the ramp integration circuit 900 may optionally integrate current from a number of ramp sense capacitors, such as optional ramp sense capacitors 906 and 908, which may each be connected to the ramp integration circuit 900 at a ramp sample connection 912. The column connection side of each additional ramp sense capacitor may in turn be selectably coupled to one or more columns via switches (not shown) similar to the switches 822, 850 and 852, as described for the ramp sense capacitor 902.

The ramp sample connection 912 may be connected via a sample reset switch 914 to a reference 916 which is the same as a reference 918 for an integration amplifier 920; with the polarities shown, it is convenient to use Vdd as the reference, though a skilled person may design a similar circuit having reversed polarities without changing the embodiment significantly.

The sample reset switch 914 may be closed any time that the ramp sample switch 904 is open; however, it should be closed from a time slightly before the end of the precharge period until slightly (e.g., ¼ μS to 10 μS) after the beginning of an exposure period, for a total period long enough to fully reset the ramp sample capacitor 902 (and optional additional sample capacitors, if used) such that the ramp sample connection point is stable at the reference voltage (Vdd, in this illustration). A sample reset control signal 922 may, for example, be a boost timing signal 924 delayed by about ¼ to 4 μS, such that it is active after the boost period ends to avoid interference from transient disturbances on Vc at the end of boost and the beginning of exposure, as described above with respect to FIG. 8.

The ramp sample switch 904 may be closed by activation of a controlling "Tsample" signal 926. The switch 904 may be closed immediately after the sample reset switch 914 opens, and should be opened again before the column capacitance Ccol 814 is discharged to ground. Ccol 814 is discharged to ground (or other low voltage to extinguish the matrix element conduction) when the column drive switch 264 is switched from connection to the current source, as shown, to the other position, ground, which typically occurs at the end of the exposure conduction period for the selected column. Thus, the Tsample signal 926 may be active during most of the exposure conduction period. At the beginning of the exposure conduction period, Tsample should remain inactive until the sample reset switch 914 is fully open, while toward the end of the exposure conduction period Tsample may be released before the column discharge begins. This may be accomplished many way, such as by creating a "pre-exposure" period signal and delaying the actual exposure conduction period by one or two clocks therefrom, and making the Tsample signal 926 active when the pre-exposure period signal is true and the sample reset period 922 is false. Many other approaches to avoid an overlap between Tsample and disturbances at the end of exposure, such as may be caused by the beginning of discharge, are possible. However, for simplicity it will be assumed hereinafter without further elaboration that control of such sample switches avoids any such overlap with switching transients. If a number of ramp sample capacitors (e.g., 902, 906 and 908) are connected at the sample point 912, then the Tsample signal 926 is preferably active only during the common exposure period while all of the columns coupled to the sample point 912 via a corresponding ramp sense capacitor are conducting, and should be made inactive before the end of the shortest of the exposures of the sampled columns. This may be accomplished by generating a logical "and" of exposure periods for all selected columns, and making the Tsample signal 926 active when such common exposure period is true and the sample reset signal 922 is false. Alternative timing control techniques may be used, such as those based on universal scan cycle count data as described hereafter with respect to FIG. 10.

In the foregoing manner, output from the ramp integration circuit 900 may be based upon signals from any combination of exposed columns during a particular scan cycle, with each ramp sense capacitor (e.g., 902, 906, 908) which is connected to a selected column providing one of the selected combination of column signals. If only one column is selected per scan, a column gain may be set for the ramp integration circuit 900 as the ratio of the corresponding ramp sense capacitor value to an integration capacitor 928. Alternatively, if the more than one column is sampled simultaneously, the gain is the ratio of the (sum of ramp capacitors) to the integration capacitor 928.

If the ramp integration circuit 900 directly drives a current mirror circuit, as shown, then the overall gain will also include a current mirror gain term $G_{CM}$, the ratio of current in a current source transistor 930 which has source resistor $R_S$ 932, to current in a current mirror transistor 934 which has source resistor $R_D$ 936. A further gain term will include the inverse of $R_I$ 938, which sets the voltage-to-current transfer from a boost adjust voltage $V_{BA}$ output 952 from the integrator amplifier 920 to a boost adjust current $I_{BA}$ 940. Of course, the integrator places a pole at a frequency of zero to achieve high gain and accurate loop control with minimum error at steady state.

The circuit of FIG. 9 shows column current via a single current source device 930. A total current mirror current $I_{CM}$ 942 may include current from an exposure current reference, Iexpr 944, and precharge current when desired. The switch 264 enables column current $I_C$ from the current source transistor 930 to the column connection 274. When a boost current switch 946 is open (i.e., "boost" 924 is false), IC may include only the exposure current (Iexpr*$G_{CM}$), and when the boost current switch 946 is closed (i.e., "boost" 924 is true), $I_C$ may include the exposure current plus the boost adjust current, $I_C$=(Iexpr+$I_{BA}$)*$G_{CM}$. Iexpr 944 is typically a selectable current level, and may be selected, for example, by an external current reference connection, or by a digitally programmable current reference within the driver device. However, Iexpr 944 need not be adjustable if the timing of the switch 964 provides all needed exposure charge control to the matrix device 224. At reset, or any time that additional current during boost is unwanted, a precharge disable signal PCDis 948 may cause a switch 950 to short the integration capacitor 928.

It should be understood that, as an alternative, the amplifier 920 may control a current source, such as (referring momentarily to FIG. 4) the source 420, which may be used in conjunction with a switch such as the switch 422. In this case the exposure current is typically provided by a separate source, such as the source 410, in conjunction with a switch 412, as described previously. To accomplish control of a device such as the source 420 (referring again to FIG. 9), the output $V_{BA}$ 952 of the amplifier 920 may be connected directly to a gate of a precharge current transistor such as the transistor 930, with or without a degenerative resistor such as Rs 932. The gain of the circuit in this case will include the gain of the driven current source device, such as transistor 930.

Timing Signals for FIGS. 8 or 9

Figure 10:
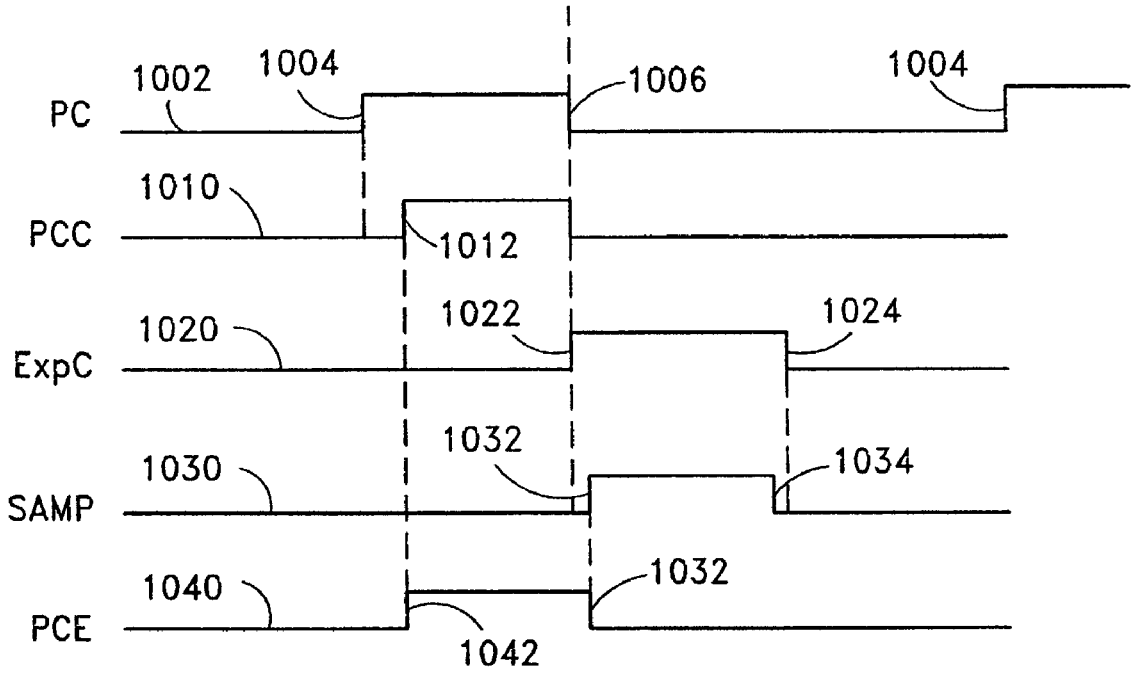
FIG. 10 is a timing diagram of exemplary column control signals for implementing embodiments of the invention.

FIG. 10 illustrates timing for global control signals which may be provided to all column drivers (or a group of drivers) within a driver device such as the array of column drivers 260 (FIG. 2), and also column control signals which may be uniquely derived for each individual column. A driver device may provide an exposure clock Cexp having a period CP equal to the minimum resolution of exposure timing.

Global signals provided to all columns of a device may include "Counter," n-bit data representing selectable times which may, for example, initiate or terminate conduction, and "PC," a signal indicating the precharge and exposure periods of a scan cycle for each row of matrix devices. Each active row is typically scanned once during each "frame." For example, for 96 rows and a frame rate of about 139 frames per second, the scan period is typically about 75 μS. A number of clock periods CP of the exposure clock Cexp per scan cycle is set to yield adequate resolution. For example, for 256 intervals during a scan period of 75 μS, CP will have a duration of about 0.29 μS. In this case, an eight-bit scan cycle timer may count from 0 to 255 each scan cycle, and may be used to establish the remaining global signals. A separate signal "Counter," delivered to each column, may be reset to zero at the beginning of each precharge period, and/or may be reset to zero at the beginning of each exposure period. "Counter" may represent all possible counts if it is large enough (8 bits in this example). However, "Counter" need not represent all clock states, nor even change at uniform intervals. During the precharge period, for example, "Counter" may represent all available states ($2^n$ states) over a limited period, such as during the first ¼ of the precharge period, by using a reduced number of bits. In this way, "Counter" provides a control range of only ¼ of the precharge period. Likewise, "Counter" similarly need not represent all possible states during the exposure period only. For example, it may represent only desired alternative exposure lengths. By doing so, fewer "Counter"

and corresponding data bits may be required; for example, four bits for "Counter" may be used to represent a limited range of 16 alternative exposure lengths, yet the resolution (e.g., 1/256 scan cycle) of such exposure lengths is unaffected.

Next, the "PC" or precharge signal 1002 is set true for a precharge duration of "PCP" (precharge period) clocks out of each scan cycle. PC 102 may be clocked true at a time 1004 when Counter=0, and may be clocked false at a time 1006 when Counter=PCP. For example, for CP=0.29 μS and a precharge duration of slightly less than 10 μS, PCP=34. Thus, the signal PC 1002 may define the beginning and end of the scan cycle. If PCP is set globally, it may be increased or decreased as a proportion of the entire scan cycle, as desired.

Each column may then produce local control signals based upon the above common signals, and further upon values which are uniquely directed to the particular column. Data representing column-specific values may be transmitted via serial or parallel data lines for latching at each appropriate column, or the data may be latched elsewhere (for example, at a central RAM buffer) and presented to each column on data output lines. Each such latched data value will typically be set for each particular scan. The latched data values may then be compared to a count value, which may be created independently at each column driver, or may be globally produced and distributed to all column drivers as a "count" bus. One possible latched value may be a precharge delay value PCD of, for example, two bits or more, generated at the beginning of the PC signal. Consistent with the timing shown in FIG. 10, this value defines the "Counter" value during precharge when precharge conduction shall commence, though it could alternatively define a precharge conduction termination "count" value. Another possible latched value may define the exposure termination counter value, ET, and may be placed in the same latch during the non-overlapping Exposure period.

Local signals derived for each column from the foregoing signals may include a precharge conduction signal PCC 1010 to provide a separately selectable precharge period for one or more columns. The signal PCC 1010 may be set true at a time 112 when Counter=PCD, and cleared at a time 1014 when the PC signal transitions to zero, i.e., at the Cexp clock occurring while Counter=PCP. An exposure conduction signal ExpC 1020 may be set true at a time 1022 indicating the beginning of the exposure period, and typically (see Alternatives section) the corresponding row driver is connected to the sink voltage at this time so that current will flow in the matrix element. The time 1022 may be equal to the time 1014 at the end of the precharge conduction period. The signal ExpC 1020 may be reset at a time 1024 when Counter=ET, such that the signal ExpC 120 is true for the correct exposure duration of EXP clock periods. A sample signal Samp 1030 may be set true when Counter=(PCP+1), and reset when Counter=(ET−1), by way of example. Thus, the signal Samp 1030 becomes true about ⅓ μS after the beginning of the exposure period (after the transient disturbances which may be produced, for example, by row switching or boost current termination), and Samp 1030 is released before the column is discharged at the end of exposure. A further signal PCExt 1040 may be generated for sampling the column voltage at the beginning of the exposure, i.e., PCExt may provide the signal "boost+" 824. PCExt represents an extension of the precharge period into the exposure period, and becomes true at a time 1042 which may conveniently be equal to the time 1012 when precharge conduction begins, or the time 1042 may be delayed to allow the column to charge substantially before the sampling of capacitor C1A 820 begins. The time 1042 is typically positioned during the time that PC is true, but may be before or after the time 1012.

The signals illustrated in FIG. 10 may be applied to provide the timing signals for the circuit of FIG. 8, to which reference is made. The switch 812 may be closed while PCC is true. The switch 826 may be controlled to be closed when ExpC is true. The control signal boost+ 824 may be true when PCExt is true. (The boost+ signals for the optional boost sample circuits 860 and 862 may similarly follow the PCExt signal for their corresponding columns.) The control signal phi1A 830 may be true when Samp is true, and the optional exposure sample circuits 870 and 872 may similarly follow the (Samp) signal corresponding to their columns. The column discharge switch 816 may be closed when ExpC becomes false (at the time 1024 in FIG. 10) and opened when PC goes true. Sampling circuits may be connected to alternative columns by enabling only the selection switch (for example, between alternatives 822, 850 and 852) corresponding to the column having the largest ET value. The phi2A, phi2B, and phi2N signals may be enabled only if the associated ET value exceeds a predetermined minimum.

The signals of FIG. 10 may similarly be applied to the circuit of FIG. 9, to which further reference is now made. The exemplary row switch 228 (representing the presently selected row in a row driver circuit 250) typically connects the row to ground, as shown, while PC is false, and connects the row to the row "off" voltage Vro while PC is true. The switch 264 may connect the column connection 274 to ground when ExpC becomes false, and then connect the column connection to the source transistor 930 while PCC is true and while ExpC is true (i.e., while PCC or ExpC is true). The boost+1 signal 922 may be true when PCExt is true. The control signal Tsample, controlling the ramp sample switch 904, may be true when Samp is true. Sensing capacitors such as 902, 906 and 908 may each be connected to a column via that switch from among available alternatives (such as the switches 822, 850 and 852) which has the highest ET value exceeding a predetermined minimum. Of course, when the ramp control circuit of FIG. 9 employs the alternative of distinct exposure and boost current source devices, appropriate aspects of the timing should be adjusted accordingly, such as is described with respect to FIG. 8.

Analog/Digital Precharge Period Control

The timing signals described with respect to FIG. 10 may be configured to control the delivered pre-exposure charge quantity by changing the Precharge Delay PCD difference between the beginning of PC at the time 1004, and the time 1012 when precharge conduction begins, i.e. signal PCC 1010 becomes true. PCD may, for example, be set by an up/down counter able to be read, written and reset by a controlling digital processor, and may be configured to count up, down, or not at all depending on the state of the analog pre-exposure charge control circuit. For example, the analog precharge control integrators of FIGS. 8 and 9 have outputs which may be distinguished by ranges, to determine whether the precharge current level set by the circuit is above, below, or within a desired range of precharge current control. If the pre-exposure charge control circuit raises the precharge current above the desired range, then PCD may be reduced (e.g., the PCD up/down counter may be directed to count down). Conversely, if the pre-exposure charge control circuit lowers the precharge current below the desired value, then PCD may be extended (e.g., the PCD up/down counter may be directed to count up). In this implementation, raising the PCD value (counting up) will further delay the onset of precharge current during precharge periods, thus reducing the total charge delivered for precharge. Such up-counting may continue until the pre-exposure charge control circuit directs the precharge current level to fall within a desired range. All counting may stop while the precharge current remains within this range, but down-counting would begin when the precharge current control fell above the desired range. Alternatively, the desired range may be just a value without a range, in which event the PCD counter will always count up or down unless counting is disabled (this could be done by recognizing that PCD is toggling between two values). The value which the counter achieves will therefore reflect the present charge requirements of the column. The current range may be independently selectable from any number of known ranges, which may enhance the resolution of the delivered charge quantity.

The precharge current conduction time may be time controlled by at least three exemplary methods. First, the precharge period may be adjusted globally (as to a group of columns, typically all columns driven by a particular driver device) to effect global variation in charge delivery. Second and third methods provide adjustment for individual columns by reducing the precharge conduction period of the particular column driver within the globally available precharge period. The second method delays the beginning of precharge current conduction time for each column as compared to the beginning of the precharge period, and terminates all precharge conduction at the end of the precharge period. The third method, conversely, begins precharge current for each column at the beginning of the precharge period, but terminates precharge current at a variable time not later than the end of the precharge period. Precharge conduction could, or course, be both delayed from the beginning of the precharge period and terminated before the end of the precharge period.

Precharge and Exposure Drive and Time Control

Figure 11:
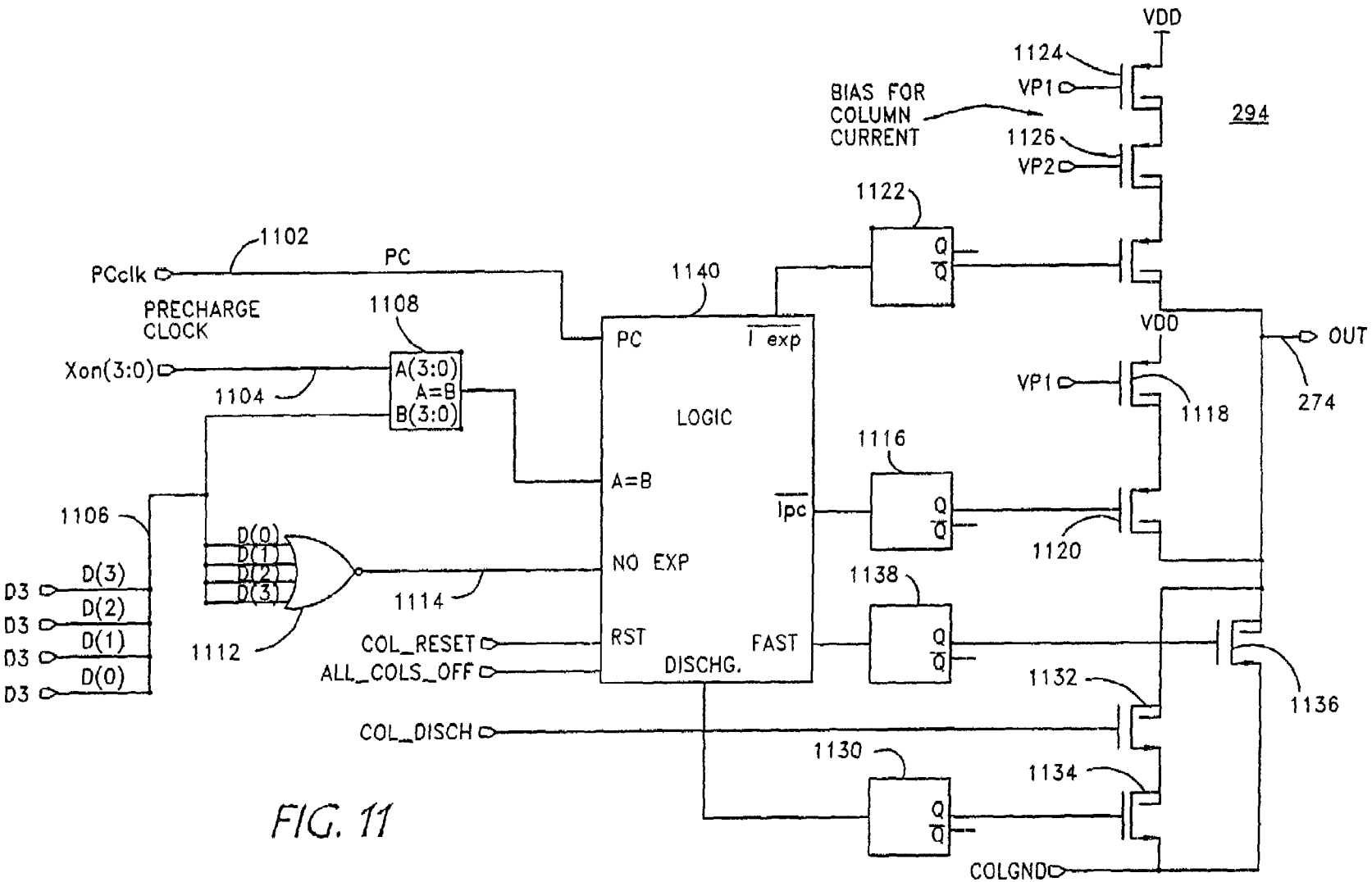
FIG. 11 is a simplified schematic representation of a column driver.

FIG. 11 illustrates an exemplary means to provide individual control of precharge and exposure current and conduction time. "Global" signals are prepared for all column drivers simultaneously. A PC connection 1102 provides the first global signal, PC (1002 in FIG. 10). A count bus 1104 provides a second signal "Xcnt," which may also be global, and may be, for example, 4 bits. A data bus 1106 provides an exposure value Xdata, which may be four bits which are uniquely set for the particular column driver 294. A digital comparator 1108 compares the values of Xcnt and Xdata and provides a compare output "A=B" 1110 which is true when the values are equal. A NAND gate 1112 may provide a "no conduction" signal output 1114 which is true when Xdata is a value of OH.

The signal PC on the PC connection 1102 may be used to define the precharge period and the exposure period, with each cycle of PC typically encompassing a scan cycle for one row. When A=B (output 1110 is true) during PC true, a boost latch/level shifter 1116 may be reset to enable boost current. Boost current may be provided, for example, from a boost current drive transistor 1118 having a bias set by a current control circuit (not shown), and may be switched to connect to the column output pad 274 by boost current switch 1120. When PC is false, the boost latch/level shifter 1116 may be set, disabling further boost current. When Xcnt is provided uniquely to the column driver 294 with a precharge conduction value, it permits a unique timing control for boost current for that column.

To conserve device space requirements, it is useful to use relatively few Xdata and Count lines, for example to four as shown, and the same is true if Xdata is sent serially and locally latched. The period between Count values may be uniformly changed during the precharge period. However, in order to maximize resolution at the expense of range, the global Count values may alternatively be provided with all possible states occurring in, for example, just the last one fourth or so of the period during which PC is true. For example, if PC is true for 12 μS, Count may step from 0 to F (hex) in 3 μS or so, giving a resolution of 1/64 of the precharge period for adjacent values within the limited range. Combined with a modest range of precharge currents, such as eight, pre-exposure charges having a range exceeding 10:1 and a resolution of 1:256 is provided. 1. Count may also be controlled in many other non-uniform ways within the precharge period.

The exposure period may be generally defined as the duration of a scan cycle when PC is false, and may also be reduced by a time allowed for discharge, when the discharge time is outside PC. Xcnt for exposure may be provided on the count bus 1106 after the A=B output 1110 has already reset the precharge latch/level shifter 1116, which may be set by the PC signal transitioning to false. Barring a "no conduction" signal 1114, an exposure conduction current latch/level shifter 1122 may be reset by the transition of PC to false. The corresponding row driver will typically be connected to a sink voltage such as ground at this transition in order to permit the matrix element pixel to conduct current and thus luminesce. When the exposure conduction current latch/level shifter 1122 is reset, an exposure current source including cascade current setting transistors 1124 and 1126 are connected to the column output pad 274 by a switch 1128. The exposure conduction current latch/level shifter 1122 may then be set when the A=B output 1110 is again true, opening the switch 1128 and discontinuing conduction current. As with the precharge current, it is not necessary that the Count values, which are globally provided on the count bus 1102, be uniformly and linearly distributed from 0 to F (or other maximum value N) across the exposure period. Instead, Count may be changed at any selected times which are desired as selectable turn-off times for column exposures. For example, the variation in time between any two adjacent count values may be logarithmic, such that the exposure time of Count value E is the same proportion of the exposure time of Count value F, as the exposure time of Count value 1 is of the exposure time of Count value 2.

Typically, conduction by the matrix element is actually terminated by column discharge, because substantial conduction would otherwise be supported by the charge on Ccol. Accordingly, when the exposure conduction is terminated upon Count=Xdata during the exposure period, discharge of the column is typically initiated immediately thereafter (unless the exposure period is not intended to match the actual conduction period). In FIG. 11, discharge is effected by enabling a slow discharge current switch 1134 to enable a discharge current which is set by the discharge current setting transistor 1132. If the slow discharge current is comparable to the precharge current, the slow discharge switch 1134 may be set for a time slightly less than the precharge period, such as about 7 μS in a typical case in which the precharge duration is about 10 μS. To ensure a complete discharge, a low-impedance switch 1136 maybe enabled shortly before the next precharge period.

Any suitable logic gates to generate the above control signals from the input signals may be disposed in a logic circuit 1140.

Opposite Rail Referenced Loop

Figure 12:
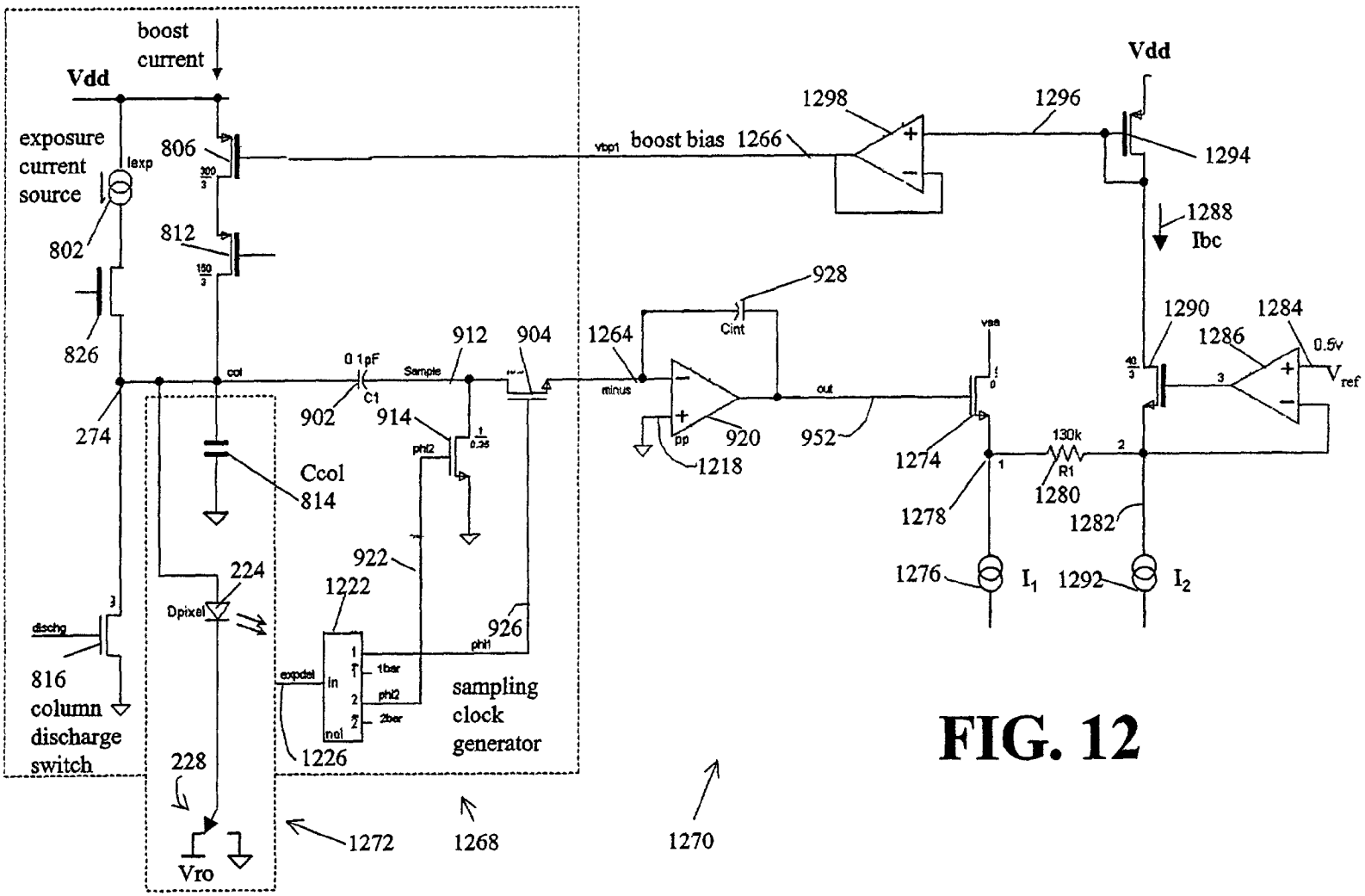
FIG. 12 is a simplified schematic diagram of a ramp-based adaptive boost circuit which senses at one rail and controls boost at the opposite rail.

In FIG. 9, Ccol 814 is shown connected to Vdd. Thus, the input 910 to the sensing circuit may well be substantially referenced to Vdd. The sensing circuit (roughly including C1 902, switches 904 and 914, amplifier 920 and integration capacitor 928) is also substantially referenced to Vdd, particularly at the reference 916 and the input 918 to the amplifier 920. In other embodiments, however, Ccol may be connected to one of many "row off" voltages Vro which vary from Vdd at frequencies of interest. It may, nonetheless, be desirable to control an output device, such as the current source 930, with reference to a supply which is not closely controlled with respect to Vro, such as Vdd. This situation, in which the controlled circuit is referenced to a different voltage than is the input circuit, will be referred to as an "opposite rail reference" circumstance. The name derives from a common example in which an input is referenced to ground (a first "rail" of a supply), but an output is referenced to a supply voltage (the opposite rail of the supply) which does not perfectly track the first rail. It should be understood, however, that the "opposite rail" circumstance covers any differing references for input and output. FIG. 12 illustrates an embodiment of ramp sensing which avoids problems which may result from "opposite rail" references. The techniques shown in FIG. 12 may also be applied to other circuits, such as are shown in FIG. 8.

FIG. 12 shows many items which may be used almost identically as in FIG. 9, and accordingly these items have the same reference designators. In general, items whose references have only the same last two numerals (i.e., 9*xx* vs. 12*xx*) are either constructed or used somewhat differently, but are otherwise similar, as between the two circuits. The exposure current source 802 provides a selected or controlled current to the column connection 274 during an exposure period when the exposure current switch 826 is enabled, and the boost current source 806 provides boost current when the boost switch 812 is enabled, as is described above with respect to FIG. 8. At the termination of exposure, the discharge switch 816 may be closed to discharge the parasitic capacitance of the column, Ccol, which may be about 2 nF and is represented by the capacitor 814. When connected to ground, the row switch 228 (typically located in a separate row driver device) enables current to flow in a matrix element represented by the LED 224. The column voltage Vcol of the column connection 274 may be connected directly to the control circuit input at the ramp sense capacitor 902, as shown, although the alternatives shown in FIGS. 8 and 9 of connecting via switches such as 822, 850 and 852 may also be employed in other embodiments. The ramp sense capacitor 902, alone, may be connected to the sample connection 912 as shown, although other ramp sense capacitors may alternatively be connected at this point, as described with respect to the capacitors 906 and 908 of FIG. 9. The reset switch 914 may be controlled by the boost+1 signal 922, and the ramp sample switch 904 controlled by the Tsample signal 926, also as described with respect to FIG. 9.

These signals may be generated by a non-overlap control device 1222, which may be a latch or a buffer with level shifting, under control of a signal 1226 which, referring for a moment to FIG. 10, may be active as described for the signal Samp 1030, from the time 1032 to the time 1034. The time 1032 is typically arranged to be within the first half of the time span from 1022 to 1024 of the corresponding exposure duration ExpC 1020. For some embodiments the time 1032 is preferably from ¼ μS to 10 μS after the time 1022, and more preferably from 1 μS to 4 μS after the time 1022. However, the signal Samp 1030 may also be referenced to the time 1034, and may be active during the latter half of the active period of the ExpC signal 1020. The signal 1226 may become inactive any time before the ExpC signal 1020 becomes inactive, but preferably before the column discharge switch 816 is activated, and more preferably by the time 1024 when exposure current is terminated. The control signal 926 may be true essentially when the signal 1226 is true, and the signal 922 may be the inverse of the signal 1226, except that the non-overlap control device 1222 preferably includes non-overlap logic to prevent the signals 922 and 926 from being true (so as to close their respective switches 914 and 904) simultaneously.

Continuing reference to FIG. 12, an integration input 1264 and a boost bias signal 1266 are shown connecting between a column drive and sample circuit 1268 and an integration and translation circuit 1270 which encompasses the rest of FIG. 12 except for the items of a group 1272 (which are typically external to a column driver device). The integration and translation circuit 1270 may be interfaced to a single column drive and sample circuit 1268, as shown, or the integration input 1264 may be received from any number of other column drive and sample circuits, while the boost bias signal 1266 may be connected to any number of other column drive and sample circuits. A group of columns which is sampled does not have to be the same as a group of columns which is controlled by the boost bias signal 1266, though it may. The number of columns sensed via the integration input 1264 affects both the circuit gain and the size needed for the integration capacitor 928 in order to establish a particular response frequency. Thus, for example, it may be desired to have a response time of about 25 mS. For a single column drive and sample circuit connected, with a ramp sense capacitor 902 value of about 0.1 pF, the integration capacitor 928 value may be very approximately 50 pF. If 128 column drive and sample circuits are connected at the input 1264, each with the same ramp sense capacitor 902 of about 0.1 pF, the capacitor 928 may be about 6.3 nF. Of course, other gains of the circuit will affect this value, as the skilled person will understand.

A reference voltage 1216 for the reset switch 914 is preferably the same as a reference voltage input 1218 for the integrator 920. In this case, the value is ground and matches the reference of the column parasitic capacitance 814. (The capacitance 814 may in practice be connected to Vro if Vro is effectively ground for circuit response purposes). Thus, the integrator input is effectively referenced to a first rail, in this case ground. The output 952 may be considered to drive an inverting, translating −Gm block to develop the boost bias signal 1266 which is output to drive one or more boost current source devices, such as the boost source 806, which is referenced to the opposite rail, in this case Vdd. The inverting, translating −Gm block may be implemented in any manner which will effect a similar result, and the illustrated circuit should be understood to be exemplary, and not limiting. The integrator output 952 controls the gate of a source follower 1274, which receives current from a first current source 1276 at a first node 1278 of a resistor 1280. Since a second node 1282 will be held at a reference voltage 1284, for example 0.5V, by the action of a simple amplifier 1286, a current Ibc 1288 through a FET 1290 is essentially the sum of a second current source 1290, which may be about 6 μA, plus current through the resistor 1280. The resistor value may be about 130K, in which case the current Ibc may be controlled from zero to about 10 μA. Even if a large number of column boost current sources place a large capacitive load on the boost bias output 1266, a current mirror FET 1294 may operate at low current to produce a boost bias level signal 1296 having a high impedance if a buffer 1298 is employed to generate the boost bias output 1266. Note that output voltage becomes referenced to the second rail, Vdd, by the current mirror FET 1294. The current mirror FET 1294 may be scaled to have about 1/300 as much current as in a boost current source 806, in order to provide a range of about 3 mA for a boost source such as 806.

Fabricating Matrix Device Drivers

Matrix conduction control devices such as are described herein may be fabricated on one or more integrated circuits. Referring to FIG. 2, it may be advantageous to fabricate a column driver device 260 having column drivers 1 to N (e.g., 292, 294, 296) on one integrated circuit, using any known integrated circuit fabrication technology capable of mixing analog drive devices and logic devices, for connection to a display device, e.g. 280. Similarly, it may be advantageous to fabricate a row driver device 250 having row drivers 1 to M (e.g., 208, 218, 228, 238 and 248) on a single integrated circuit for a display device such as 280. Moreover, it may be useful, particularly for small display devices, to fabricate a row/column driver device as an integrated circuit including as many column drivers (e.g., 294) as the matrix device 280 has columns, and also as many row drivers (e.g., 228) as the matrix device 280 has rows, along with supporting global logic. RAM or ROM may be provided in row/column driver devices, column driver devices 260, or row driver devices 250 to provide command latching, along with tables and logic for generating appropriate "Counter" and "Xdata" signals. In some cases it will be useful to include microprocessor functionality on such an integrated circuit, as well. Thus, circuits performing any combination, including all, of the matrix element current drive methods described herein may be fabricated as discrete elements, hybrids, or, especially, as integrated circuits.

Integrated circuits may be fabricated to have connection pads similar to surface-mount pads. Such pads may be used for surface mount on printed circuit boards, and may also be used for direct connection between a matrix display device, such as 280, and such integrated circuit. The integrated circuit(s) connected to a matrix device may be configured to effect any combination of the driver methods described herein. Individually or as a group, such integrated circuits may provide any combination of one or more row/column driver devices, one or more row driver devices 250, one or more column driver devices 260, and/or one or more logic or microprocessor devices. Any combination of the devices described above may be fabricated as an interconnected unit using any connection technique, such as infra-red surface mount soldering, wire-bonding, ribbon cabling or pressure interconnects to provide connection between devices within such an assembly.

Each column driver may, of course, be provided with a separate current reference and current mirror transistors. However, it is often convenient to provide a common gate bias voltage for current source FETs for a number, or even for all N, current drivers in a device such as the driver device 260 in FIG. 2. A single current reference may be provided, either externally generated or internally provided by a current DAC, to a single diode-connected FET which in turn provides gate bias for the corresponding current-source transistor in each column. Other forms of common bias schemes may be used, including self-adjusting circuits to adjust bias at the physical extrema of the current source FETs which share the biasing scheme. One such scheme sets bias voltages independently at each end of a series of current sources to generate the same reflected current at both ends, and then "interpolates" the bias voltage by a means, such as a resistive divider, which causes the bias voltage to change linearly between the gate of one extreme FET to the gate of the other extreme FET. Whatever shared-bias scheme is used, it may cover each adjacent driver circuit. In circumstances such as multi-color display driving, however, adjacent drivers may need to drive different currents, and/or may have different bias voltages. To accommodate this, bias may be shared between related but non-adjacent drivers. For example, in an n-pixel three-color system, drivers 1, 4, 7 . . . (3n−2) may share one bias circuit, drivers 2, 5, 8, . . . (3n−1) may share another bias circuit, and drivers 3, 6, 9, . . . (3n) may share a third bias circuit. Of course, bias circuits may encompass less than all n corresponding drivers. Extension of non-adjacent driver bias sharing may also be extended to driver devices having either two, or four or more, distinct driver types.

It will typically be useful to provide certain large capacitances externally to the integrated circuits. For example, a capacitor of about 1 μF to 220 μF may be connected from ground to a connector of any such device which is connected to the row off voltage Vro, and another such capacitor to a pixel supply voltage Vdd or to a logic supply Vll, or to a column discharge level supply Vdis to which columns are connected during discharge. Values outside this range may also be used, though possibly with reduced performance. The capacitors may be fabricated by any suitable process. Display assemblies may be fabricated to include a display matrix device, e.g. 280, coupled to any or all of row/column driver devices, column driver devices 260, row driver devices 250, supply capacitors, and control logic and/or processor devices.

Other Alternatives and Extensions

The above description has pointed out novel features of various embodiments, and the skilled person will understand that various omissions, substitutions, and changes in the form and details of the device or process illustrated may be made without departing from the scope of the invention. For example, the orientation, polarity, and connections of devices in the display matrix is a matter of design convenience, and the skilled person will be able to adapt the details described herein to a system having different devices, different polarities, or different row and column architectures.

The rows are described as being connected, during precharge, to a voltage Vro which can range from just enough to prevent conduction ([Vcol−Vf(min)]), to just below breakdown voltage, ([Vdis+Vbr(min)]), where Vf(min) is the minimum element conduction voltage, Vdis is the voltage to which the column is discharged, Vcol is the column voltage, and Vbr(min) is the minimum breakdown voltage of a matrix element. However, some active rows may be connected to a sink voltage during precharge, such that pixels are caused to conduct current during the precharge period. In this event, luminescence of pixels may not track the supplied charge as linearly as when precharge and exposure current delivery is separated.

The voltage Vdis to which columns are driven to terminate their exposure has been typically described as zero, or other low voltage. This voltage need only be low enough to ensure that the device being terminated will promptly cease conducting for all practical purposes, e.g., to a current level corresponding to a level of light output that is low enough relative to the average display luminosity that a pixel will appear "black" to the human eye, relative to other driven pixel elements in the display matrix. Thus, this voltage should not provide more than Vf(min) to the matrix devices, taking into account, if desired, the voltage of the row during conduction. Lower values are also appropriate, so long as they do not cause the reverse breakdown voltage for the matrix devices to be exceeded. Higher values may reduce power dissipation due to charge and discharge of each matrix element. Discharging columns, at the end of exposure conduction periods, to a value of Vdis which is greater than zero, will save a portion of power dissipation. If Vf and Vc voltages rise with age, savings may be extended if Vdis is raised accordingly. Moreover, further power savings maybe realized if the Vdis voltage is also used for some necessary purpose. If a logic supply voltage of 2.7 V is used as Vdis, instead of ground (0 V), the current provided to the logic supply when columns are discharged may save power otherwise needed to generate such a supply. Such saving is in addition to the reduction in precharge current drain from the precharge supply due to raising Vdis.

The order in which rows are scanned during a refresh sequence has generally been assumed as sequential between adjacent rows. However, other sequences of rows may be used during refresh cycles. For example, one may scan odd rows 1, 3, 5 . . . and then even rows 2, 4, 6 . . . , thereby interleaving the scans, which may smooth the display appearance. Other sequences, even random sequences, may also be used. Typically, each row which has elements to be exposed is scanned only one time before scanning one of the rows again. However, rows may be scanned extra times before all rows to be exposed have been scanned. This may be done, for example, in order to obtain extra brightness for the corresponding elements connected to such rows.

Current sources, such as the current source 284 in FIG. 2, may include a single current source with appropriate circuitry to change the current level for precharge and exposure levels. Alternatively, distinct precharge and exposure current sources may be included; and indeed, any particular current source may include more than one current source devices, such as a fixed current source and an adjustable current source for additional current. Moreover, a current source may be constructed along the lines of a current DAC, with a large number of digitally selectable current combinations able to reflect a range of digital inputs. Net charge delivered is typically the primary consideration for both precharge and exposure, with net photons emitted being generally proportional to conducted charge, at least for similarly aged pixels. The net precharge column voltage is typically pre-exposure charge divided by net column capacitance, Qpc/Cnet, although the values will be raised by any non-zero discharge voltages.

Delays between drive signal transitions on the one hand (transitions such as from precharge to exposure and from exposure to off), and sample switch or transfer switch timing on the other hand, are frequently described as being about one or two clock periods, or about ¼ to 4 μS. Such delays may also be more or less than this, ranging from 0 to 10 μS and including fractional clock periods. The delays are preferably long enough to avoid transient column voltage and other disturbances, yet short enough to avoid substantially reducing the effective sampled period.

For the adaptive precharge control methods and apparatus described herein, early and late sample times within the conduction period need not be maximally separated, but are preferably substantially separated. Early samples may be taken from slightly before a conduction period until well into the conduction period, while late samples may be taken any time substantially after an early sample time, following an early sample time by a time ranging from about 5% to about 100% of a conduction period. A late sample is substantially later than an early sample as long as the time difference is sufficient to permit the column voltage to move far enough to provide a useable signal which is well above the signal-noise level.

Referring to FIG. 10, the time 1034 at which Samp ends may be set to a fixed value (for example, 20 μS after PC becomes false, or a percentage, such as 20%, of an exposure period). Such fixed time may reflect a minimum exposure time, and selection transistors such as 822, 850 and 852 in FIGS. 8 and 9 may be opened if the column to which they are connected has an exposure which is shorter than the minimum exposure time. Such fixed times between samples may help to balance the gain with respect to each measured element.

A fixed time between the beginning and end of the signal Samp 1030 in FIG. 10 may be varied linearly, inverse to changes in the exposure conduction current, in order to balance gain across different current settings. Sample timing locations may be positioned relative to either the beginning or the end of the span of conduction periods to which the samples correspond, for example to be closer to exposure termination or closer to exposure initiation. The best approach depends upon system details, because while sensitivity may be higher earlier in conduction period spans, row conduction voltage artifacts may be less pronounced later in conduction period spans.

The described embodiments, with corresponding aspects modified in accordance with the above alternatives, are contemplated as alternative embodiments of the invention. The scope of the invention is defined by the appended claims, rather than being limited to foregoing description. All variations coming within the meaning and range of equivalency of the claims are embraced within their scope.

What is claimed is:

1. A method of controlling a quantity of electrical charge provided to a matrix display connection during a precharge period, the method comprising:

driving a current through a matrix element connected to a first matrix connection during a conduction period;

deriving a control voltage from at least one voltage from a path of the current, wherein the control voltage level is based on voltages of the first matrix connection generated at a plurality of distinct periods during the conduction period;

adjusting the quantity of electrical charge based at least in part upon the derived control voltage; and providing the adjusted electrical charge quantity to a second matrix connection during the precharge period.

2. The method of claim 1, wherein the first and second matrix connections are the same connection.

3. The method of claim 1, further comprising changing the provided electrical charge quantity by changing a level of precharge current supplied during the precharge period.

4. The method of claim 1, further comprising changing the provided electrical charge quantity by applying precharge current for a selectively changed duration during the target precharge period.

5. The method of claim 1, further comprising changing the electrical charge quantity provided to a particular matrix connection during the precharge period by providing current to the particular matrix connection for an adjusted length of time within the precharge period.

6. The method of claim 1, wherein:

a first period of the plurality of distinct periods is within four microseconds of a beginning of a conduction period; and a second period of the plurality of different periods is closer to an end than to the beginning of the conduction period.

7. The method of claim 1, wherein a first period of the plurality of distinct periods is an early period located closer to a beginning than to an end of a corresponding conduction period.

8. The method of claim 7, wherein a second period of the plurality of distinct periods is a late period which ends a substantially greater time after a beginning of an associated conduction period than a time between the end of the early period and the beginning of the conduction period corresponding to the early period.

9. The method of claim 8, wherein the early period and the late period end during the same conduction period.

10. The method of claim 1, wherein the control voltage is responsive to a combination of voltages corresponding to a plurality of elements conducting concurrently.

11. The method of claim 1, wherein the control voltage is responsive to a combination of voltages derived from a plurality of elements conducting nonconcurrently.

12. The method of claim 1, wherein the matrix element comprises an organic light emitting diode (OLED).

13. The method of claim 1, further comprising:

digitizing voltages present during conduction; and manipulating resultant digitized voltage values to control adjustment of the charge quantity.

14. The method of claim 1, further comprising discharging a particular matrix connection to a lower voltage during an exposure period at a termination of a conduction period for the particular matrix connection.

15. The method of claim 1, further comprising:

deriving the control voltage with respect to a first reference voltage; and adjusting the charge quantity with respect to a second reference voltage.

16. A method of controlling a quantity of electrical charge provided to a matrix display connection during a precharge period, the method comprising:

driving a current through a matrix element connected to a first matrix connection during a conduction period;

deriving a control voltage from at least one voltage from a path of the current;

adjusting the quantity of electrical charge based at least in part upon the derived control voltage; and providing the adjusted electrical charge quantity to a second matrix connection during the precharge period, wherein:

the control voltage is responsive to a difference between a first voltage and a second voltage;

the first voltage is derived from at least one voltage generated during an early portion of the conduction period; and the second voltage is derived from at least one voltage generated after the early portion of the conduction period.

17. The method of claim 16, further comprising:

determining differences between the first voltage and the second voltage;

integrating the differences; and adjusting a charge delivered during the target precharge period based on a result of the integration.

18. The method of claim 17, further comprising changing the quantity of charge delivered during the precharge period by adjusting a current level supplied during the precharge period.

19. The method of claim 16, further comprising providing at least a part of the charge quantity under control of a current reference.

20. The method of claim 19, wherein the current reference controls the current.

21. A method of controlling a quantity of electrical charge provided to a matrix display connection during a precharge period, the method comprising:

driving a current through a matrix element connected to a first matrix connection during a conduction period;

deriving a control voltage from at least one voltage from a path of the current;

adjusting the quantity of electrical charge based at least in part upon the derived control voltage;

providing the adjusted electrical charge quantity to a second matrix connection during the precharge period;

sampling voltages from selected matrix connections at early and late times relative to corresponding conduction period spans;

determining a difference between the voltages sampled at early times and the voltages sampled at late times; and adjusting the charge quantity in accordance with a deviation of the determined difference from a desired value for the difference.

22. A method of controlling a quantity of electrical charge provided to a matrix display connection during a precharge period, the method comprising:

driving a current through a matrix element connected to a first matrix connection during a conduction period;

deriving a control voltage from at least one voltage from a path of the current;

adjusting the quantity of electrical charge based at least in part upon the derived control voltage;

providing the adjusted electrical charge quantity to a second matrix connection during the precharge period; and omitting provision of boost current to a particular matrix element connection during a precharge period preceding an exposure period for which a conduction period of zero is assigned to the particular matrix connection.

23. A method of controlling a quantity of electrical charge provided to a matrix display connection during a precharge period, the method comprising:

driving a current through a matrix element connected to a first matrix connection during a conduction period;

deriving a control voltage from at least one voltage from a path of the current;

adjusting the quantity of electrical charge based at least in part upon the derived control voltage;

providing the adjusted electrical charge quantity to a second matrix connection during the precharge period; and providing a boost current to a matrix connection during a particular precharge period only when;

(i) the matrix connection has not conducted current since a most recent discharge of the connection; and (ii) a non-zero conduction is assigned for the matrix connection during a conduction period immediately following the particular precharge period.

24. A method of manufacturing a circuit for controlling current drive to display elements, comprising:

configuring a plurality of exposure current sources to provide exposure currents to a plurality of display elements during an exposure period;

connecting a voltage sampling circuit, configured to obtain a plurality of sample voltages, to at least one conduction path of the exposure currents;

configuring combiner circuitry to combine the plurality of sample voltages;

connecting a precharge current source to at least one of the plurality of display elements to supply a precharge current thereto during a precharge period;

providing a control, responsive to a combination of the plurality of sample voltages, of the precharge current delivery;

incorporating an early sample combiner configured to combine voltages sampled during early portions of exposure period;

configuring a late sample combiner to combine voltages sampled during later portions of the exposure period; and controlling the precharge current control circuit based at least in part on differences between combined early voltages and combined late voltages.

25. The method of claim 24, wherein:

the precharge current delivery control comprises a current control signal that is responsive to the plurality of sample.

26. The method of claim 24, further comprising configuring the precharge current delivery control to adjust level of the precharge current during the precharge period.

27. The method of claim 24, further comprising configuring the control to adjust duration of current delivery during precharge.

28. A method of controlling conduction of electrical charge to a matrix display during a precharge period, the method comprising:

supplying a current to a matrix element during a conduction period;

obtaining early conduction voltages at an early time preceding midway through the conduction period;

deriving a control voltage from at least one voltage from a path of the conduction period current;

adjusting a charge quantity based at least in part upon the derived control voltage; and providing the adjusted charge quantity to at least one matrix element during a subsequent precharge period.

29. The method of claim 28, wherein:

deriving a control voltage comprises relating the control voltage to a first reference voltage; and adjusting the charge quantity comprises providing a current control signal with respect to a different second reference voltage.

30. The method of claim 28, further comprising obtaining late conduction voltages at a late time which is later than the early time and within the conduction period.

31. The method of claim 30, wherein obtaining the early and late conduction voltages occurs within a single conduction period.

32. The method of claim 31, further comprising determining the derived control voltage based at least in part on a comparison of early and late conduction voltages.

33. The method of claim 32, further comprising integrating differences between early and late voltages.

34. An apparatus for driving current in devices of a matrix, comprising:

a first driver circuit connectable to a first terminal of a matrix element to provide a current thereto;

a sink circuit connectable to a second terminal of the matrix element to accept current conducted by the matrix element;

a sensing circuit configured to store a voltage developed when the matrix element conducts part of the current, wherein the sensing circuit is configured to sense voltages developed at a plurality of different times relative to a conduction period span; and a second driver circuit configured to output a quantity of charge which varies in response to the stored voltage.

35. The apparatus of claim 34, wherein the second driver circuit drives a current at a level which varies in response to the stored conduction voltage.

36. The apparatus of claim 34, wherein the second driver circuit comprises a precharge circuit having a conduction time control configured to conduct for a selectably variable portion of a precharge period.

37. The apparatus of claim 34, wherein:

the sensing circuit is further configured to sense early voltages at times less than half of the conduction period span from a beginning of the span; and the sensing circuit is further configured to sense late voltages at conduction period times substantially later than early voltage sensing times.

38. The apparatus of claim 37, wherein the second driver circuit is configured to adjust the output charge quantity based upon a difference between the early voltages and the late voltages.

39. The apparatus of claim 38, wherein the second driver circuit is configured to adjust the output charge quantity by varying a precharge current drive level based upon the difference between the early voltages and the late voltages.

40. The apparatus of claim 34, further comprising switches selectably coupling the sensing circuit to one of a plurality of matrix element voltages.

41. The apparatus of claim 34, further comprising a plurality of switches configured to selectably couple a plurality of voltage sensing circuits to a pre-exposure charge adjusting circuit.

42. The apparatus of claim 41, wherein the voltage sensing circuits comprise sample and hold circuits.

43. The apparatus of claim 42, wherein the pre-exposure charge adjusting circuit comprises a digital processor.

44. The apparatus of claim 34, wherein the matrix element comprises an organic light emitting diode (OLED).

45. The apparatus of claim 34, wherein the sensing circuit further comprises a combining circuit for combining voltages sensed at different times.

46. The apparatus of claim 45, wherein the combining circuit is configured to combine sensed voltages which correspond to different scan cycles.

47. The apparatus of claim 46, wherein the combining circuit comprises a first combining circuit configured to combine a plurality of voltages each sensed during an early portion of a corresponding conduction period to form a combined early voltage.

48. The apparatus of claim 47, further comprising a second combining circuit configured to combine a plurality of voltages each sensed during a late portion of a conduction period to form a combined late voltage.

49. The apparatus of claim 48, further comprising:

an integrator configured to integrate a value derived from a difference between the combined early voltage and the combined late voltage and producing an integrated difference value; and a precharge current level control circuit responsive to the integrated difference value.

50. The apparatus of claim 49, wherein the integrator and precharge current level control circuit operate on digital value representations.

51. The apparatus of claim 49, wherein the integrator and precharge current level control circuit do not require digital representation of values.

52. The apparatus of claim 34, wherein the sensing circuit further comprises a combining circuit for combining voltages sensed at concurrent times.

53. An apparatus for driving current in devices of a matrix, comprising:

a first driver circuit connectable to a first terminal of a matrix element to provide a current thereto;

a sink circuit connectable to a second terminal of the matrix element to accept current conducted by the matrix element;

a sensing circuit configured to store a voltage developed when the matrix element conducts part of the current, wherein the sensing circuit is configured to sense voltages developed at a plurality of different times relative to a conduction period span; and a second driver circuit configured to output a quantity of charge which varies in response to the stored voltage, wherein:

the sensing circuit is further configured to sense the voltage relative to a first reference voltage; and the second driver circuit is further configured to control a current source with respect to a different second reference supply of voltage.

54. An apparatus for controlling the supply of a current to a plurality of display elements, comprising:

an exposure current source configured to provide a current to at least one of the display elements during exposure periods;

a voltage sampling circuit configured to obtain a plurality of sample voltages from a conduction path of the exposure current;

a sample voltage combiner configured to combine the plurality of sample voltages; and a precharge circuit configured to change a precharge current level based at least in part upon the combined sample voltages, wherein the plurality of sample voltages are obtained relative to a first reference voltage; and the precharge circuit comprises a precharge current source controlled by a signal with respect to a different second reference voltage.

55. The apparatus of claim 54, further comprising:

a first sample combiner configured to combine voltages sampled during a first portion of an exposure period; and a second sample combiner configured to combine voltages sampled during a second portion of the exposure period, wherein the first portion occurs before the second portion; and wherein the precharge circuit is further configured to adjust the precharge current level based upon differences between combined early voltages and combined late voltages.

56. An apparatus for driving current in devices of a matrix, comprising:

means for driving current to a matrix element during a conduction period;

means for receiving current from the matrix element;

means for sensing a voltage developed when the matrix element conducts at least part of the conduction current, wherein the means for sensing the voltage comprises means for sensing voltages developed at a plurality of different times relative to a conduction period span; and means for outputting, during a precharge period, a quantity of charge which varies in response to a signal derived from the means for sensing the voltage.

57. The apparatus of claim 56, wherein:

the voltage sensing means senses the voltage relative to a first reference voltage.

58. The apparatus of claim 56, wherein the means for outputting a charge quantity during precharge comprises a means for adjusting a precharge drive current in response to a signal derived from the means for sensing the voltage.

59. The apparatus of claim 56, wherein the means for outputting a charge quantity during precharge comprises means for conducting current for a selectably variable portion of a precharge period.

60. The apparatus of claim 56, wherein the means for sensing the voltage comprises:

means for sensing early voltages at early voltage sensing times which are less than half of a conduction period span from a beginning of the span; and means for sensing late voltages at conduction period times which are substantially later than early voltage sensing times.

61. The apparatus of claim 60, wherein the means for outputting a charge quantity during precharge comprises means for adjusting the output charge quantity based upon a difference between the early voltages and the late voltages.

62. The apparatus of claim 61, wherein the means for outputting a charge quantity during precharge comprises means for adjusting the output charge quantity by varying a precharge current drive level based upon the difference between the early voltages and the late voltages.

63. The apparatus of claim 56, further comprising means for selectably coupling the voltage sensing means to one of a plurality of matrix elements.

64. The apparatus of claim 56, further comprising means for selectably coupling a plurality of voltage sensing circuits to a pre-exposure charge adjusting circuit.

65. The apparatus of claim 64, wherein the means for sensing the voltage comprises at least one sample and hold circuit.

66. The apparatus of claim 65, wherein the pre-exposure charge adjusting circuit comprises a digital processor.

67. The apparatus of claim 65, wherein the pre-exposure charge adjusting circuit comprises an integrated circuit.

68. The apparatus of claim 56, wherein the means for sensing the voltage comprises means for combining voltages sensed at different times.

69. The apparatus of claim 68, wherein the means for sensing the voltage comprises means for combining sensed voltages which correspond to different scan cycles.

70. The apparatus of claim 69, wherein the means for sensing the voltage comprises means for combining a plurality of voltages, each sensed during an early portion of a corresponding conduction period, to form a combined early voltage.

71. The apparatus of claim 70, wherein the means for sensing the voltage further comprises means for combining a plurality of voltages, each sensed during a late portion of a conduction period, to form a combined late voltage.

72. The apparatus of claim 71, wherein:

the means for sensing the voltage further comprises means for obtaining differences between the combined early voltage and the combined late voltage;

the means for sensing the voltage further comprises means for integrating the obtained differences; and wherein voltage derived from the means for sensing the voltage is derived from the integrated differences.

73. The apparatus of claim 72, wherein the obtained differences are represented digitally.

74. The apparatus of claim 72, wherein the obtained differences are represented by circuit voltages.

* * * * *